United States Patent [19]

Araki et al.

[11] Patent Number: 4,548,029

[45] Date of Patent: Oct. 22, 1985

[54] METHOD OF AND APPARATUS FOR EXCHANGING BOBBINS IN A FLYER FRAME

[75] Inventors: Hidejiro Araki, Toyoake; Katsumi Nakane, Okazaki; Susumu Otani, Obu, all of Japan

[73] Assignee: Kabushiki Kaisha Toyoda Jidoshokki Seisakusho, Kariya, Japan

[21] Appl. No.: 545,966

[22] Filed: Oct. 27, 1983

[30] Foreign Application Priority Data

Nov. 2, 1982 [JP] Japan ..... 57-192819

[51] Int. Cl.[4] ..... D01H 9/02; D01H 9/08

[52] U.S. Cl. ..... 57/267; 57/270; 57/274; 57/281

[58] Field of Search ..... 57/266–268, 57/270, 274, 276, 281

[56] References Cited

U.S. PATENT DOCUMENTS 3,765,160 10/1973 Bethea et al. ..... 57/268
3,788,054 1/1974 Haussmann et al. ..... 57/281
3,935,699 2/1976 Iida et al. ..... 57/267
3,938,308 2/1976 Komura et al. ..... 57/266
4,023,338 5/1977 Tooka et al. ..... 57/267

*Primary Examiner*—John Petrakes
*Attorney, Agent, or Firm*—Brooks Haidt Haffner & Delahunty

[57] ABSTRACT

A truck carrying plural rows of vertically placed empty bobbins is conveyed to one end of the machine base of a flyer frame, the empty bobbins of the first row are taken out of the truck and conveyed to an empty bobbin supply device on the machine base, the truck is moved a predetermined distance by an intermittent feed unit, and fresh full yarn packages from the flyer frame already placed on a conveyor are transferred by a full yarn package transfer device to said truck at the positions from which the empty bobbins were removed. The operation of taking empty bobbins from the truck and supplying them to the empty bobbin supplying device on the machine base and the operation of transferring the full yarn packages to said truck are performed in an alternate fashion.

11 Claims, 43 Drawing Figures

METHOD OF AND APPARATUS FOR EXCHANGING BOBBINS IN A FLYER FRAME

BACKGROUND OF THE INVENTION

This invention relates to a method of exchanging bobbins in a flyer frame and an apparatus therefor.

Recently, many attempts have been made to adopt large package bobbins and high speed rotation of the flyer frame in order to contribute to the efficiency of the spinning industry. Consequently, an efficient doffing operation has become a very important problem, the solution to which is essential to the success of the adoption of the large package bobbin and high speed rotation of the flyer frame. Manual handling of large packaged bobbins means a heavy operation to workers and a prolonged work time thus considerably reducing operational efficiency of the flyer frame. Thus there is a strong demand for automation of the doffing operation and hence various devices have been proposed for automatically discharging full yarn or roving packages and automatically supplying empty bobbins.

In some of these prior-art devices, one end of the machine base is provided with a unit for automatically discharging full yarn packages and the other end is provided with a unit for automatically supplying empty bobbins. Full yarn packages delivered from the spinning machine are transferred to conveyor means interposed between said units and are discharged automatically in the course of one cycle of operation of the conveyor means, to which empty bobbins are replenished automatically. In others, an automatic full yarn package discharge unit and an empty bobbin supply unit are provided at one end of the machine base. Conveyor means are operated in the normal direction for automatically discharging full yarn packages and in the reverse direction for automatically replenishing empty bobbins.

However, in the former device, the place of discharging full yarn packages is separated from the place of replenishing empty bobbins, thus greatly increasing operational inconvenience. In the latter device, a complicated operation is involved in switching between normal and reverse operations of the conveyor means and in alternately connecting the full yarn package discharge unit and the empty bobbin supply unit to the conveyor means. In addition, in these prior-art devices, since the discharged full yarn packages are stacked on a conveyor car for transport to the subsequent step, the yarn tends to be damaged. The full yarn bobbins must be taken out of the conveyor car manually which considerably interferes with the automation of the operation in the subsequent step.

In order to overcome such deficiency, it has also been proposed to provide an overhead girder from which is hung a conveyor magazine which in turn carries full yarn packages discharged from the conveyor means by an automatic discharge unit for transport to the subsequent spinning process. However, the spinning machine is usually operated on a 24-hour basis to improve the overall operational efficiency of the spinning plant. Thus it is necessary to store fresh full yarn bobbins at all times on a large number of conveyor rails, in addition to the usual conveying route from the conveyor means to the spinning machine, thus considerably increasing investment costs.

In addition, the aforementioned prior-art automatic empty bobbin supply device has a drawback in that a large space is required for storing a large number of empty bobbins besides the empty bobbin supply device adapted for separately supplying empty bobbins to bobbin holders on the conveyor means, said empty bobbins being large-sized due to adoption of large package bobbins.

SUMMARY OF THE INVENTION

The present invention has been made for overcoming these drawbacks of the prior-art devices. It is an object of the present invention to provide a doffing method and apparatus whereby the full yarn packages fresh from the flyer frame may be conveyed to a truck for transport to the subsequent step without damage to the yarn and wherein there is no requirement for space to store a large number of empty bobbins.

According to the invention, a truck carrying plural rows of vertically placed empty bobbins is conveyed to one end of the machine base of the flyer frame, the empty bobbins of the first row are taken out of the truck and conveyed to an empty bobbin supply device on the machine base, the truck is moved a predetermined distance by an intermittent feed unit, and fresh full yarn packages from the flyer frame and already placed on a conveyor are transferred by a full yarn bobbin transfer device to said truck at those positions from which the empty bobbins have been removed. The operation of taking out empty bobbins from the truck and supplying them to the empty bobbin supplying device on the machine base and the operation of transferring the full yarn packages to said truck are performed in an alternate fashion. In this manner, the full yarn packages may be transferred to the truck for transport to the next step without damaging the yarn through manual contact. In addition, a large storage space for a large number of long empty bobbins may be eliminated thus enabling the size of the overall device to be reduced. The full yarn bobbins may be transported by the truck in the vertical state thus facilitating automatic operation in the ensuing process.

BRIEF DESCRIPTION OF THE DRAWINGS

FIG. 4(*b*) is a schematic plan view showing the upper right-hand surface thereof;

FIGS. 26 through 29 illustrate the operation of the empty bobbin transport device, wherein FIG. 26 is a sectional view showing the empty bobbin suspension unit being lowered;

FIG. 27 is a sectional view showing the empty bobbin suspension unit being raised;

FIG. 28 is a front view showing empty bobbins being suspended, with a part being broken away;

FIG. 29 is a front view showing empty bobbins being transported to the empty bobbin supply box;

FIGS. 34 through 42 illustrate the operation of the full yarn bobbin transfer device, wherein FIG. 34 is a front view showing full yarn bobbins suspended from journal members;

FIG. 35 in a left-hand side elevation thereof;

FIG. 36 is a schematic front view showing the route through which the full yarn package is moved until it is suspended by journal members;

FIGS. 37, 38 are side elevations showing essential elements;

FIG. 39 is a front view showing the full yarn package suspended from the full yarn package holding and inserting devices, a part thereof being broken away;

FIGS. 40, 41 are sectional views showing a switching operation of the full yarn package inserting device; and FIG. 42 is a front view showing the full yarn bobbin placed on the truck, with part being broken away.

DESCRIPTION OF THE PREFERRED EMBODIMENT

Figure 1:
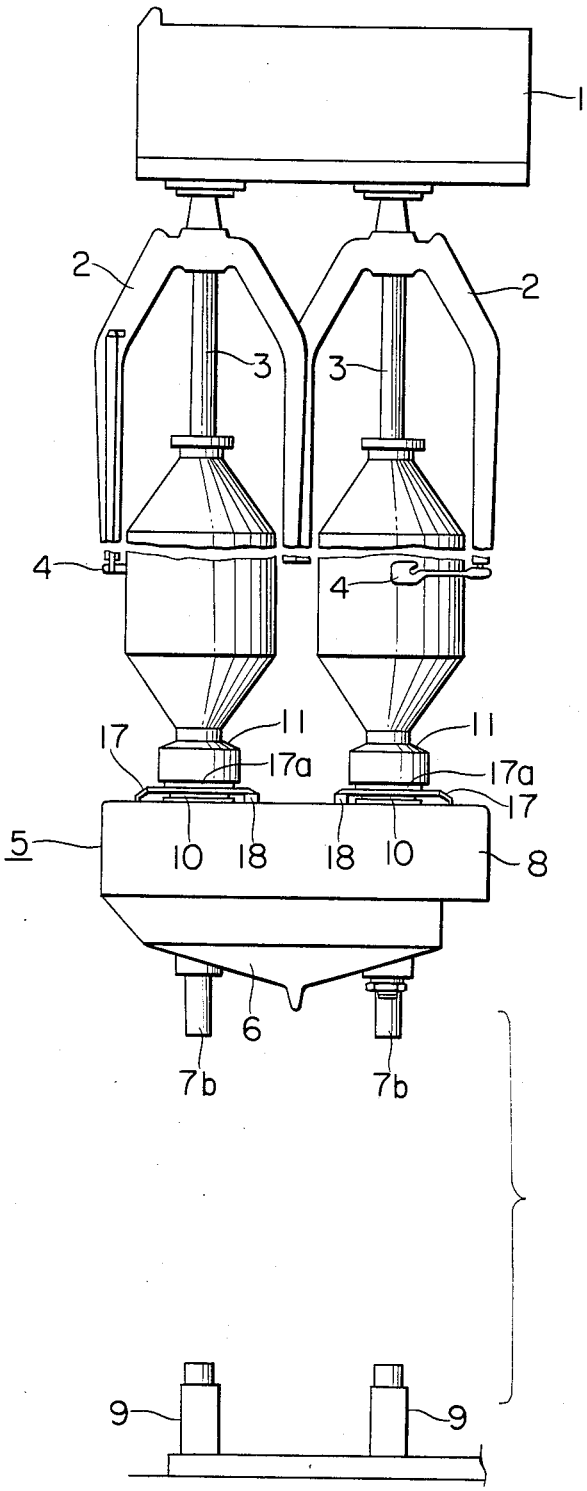
FIG. 1 is a side elevation showing the twisting and winding operation of the flyer frame embodying the present invention.
Figure 2:
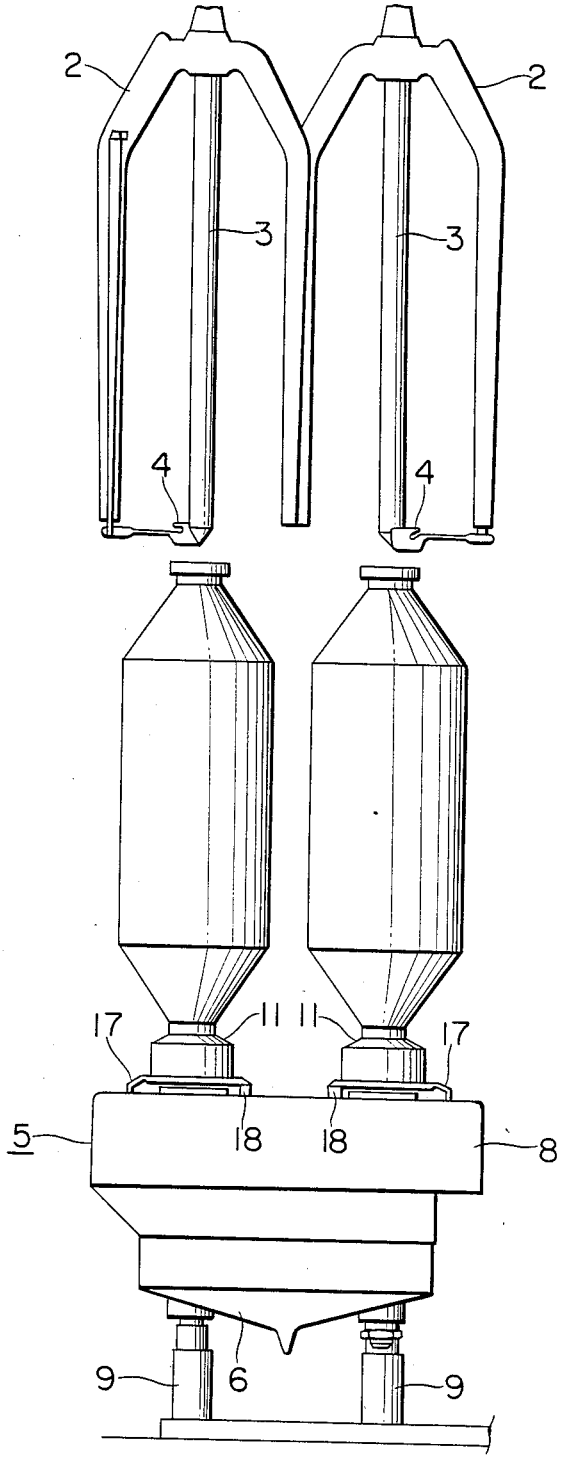
FIG. 2 is a side elevation showing the doffing operation.

Referring to the accompanying drawings and especially to FIGS. 1 and 2, a large number of flyers 2 each in the shape of an inverted letter U are suspended from an upper rail 1 of a flyer frame in two rows and in a staggered relation facing towards the lower side of the frame. Each spindle 3 projects from the lower central surface of each said flyer 2 to the level of the lower extremity of the flyer 2. A horizontally extending presser 4 is mounted on the lower end of one arm of the flyer 2.

A lower frame body 5 is mounted below said upper rail 1 for vertical movement, and comprises a substantially box-shaped bobbin rail 6 opened at its upper surface, a conveyor rail 7 (FIG. 3) mounted on said upper surface for separation vertically from said bobbin rail 6, and a substantially box-shaped conveyor cover 8 opened on its lower surface and overlying the upper surface of the conveyor rail 7. At the upper yarn winding position shown in FIG. 1, the lower frame body 5 is movable vertically as one unit within a predetermined traverse stroke. For doffing, the lower frame body is lowered to the doffing position shown in FIG. 2 to be supported on stopper pieces 9 projectedly mounted on the flyer frame base.

On the bobbin rail 6, bobbin driving shafts 10 are mounted in alignment with the rotational axis of each flyer 2. The upper end of each bobbin driving shaft 10 has a tapered supporting tubular portion 10*a* and a pair of engaging portions 10*b*. When the lower frame body 5 is at the upper yarn-winding position, each tubular portion 10*a* is projected above the upper surface of the conveyor cover 8, via a through-hole in the conveyor rail 7 and in the conveyor cover 8, for intruding into the bottom of the associated bobbin 11 and mating with an associated mating portions 11*b* of the bobbin 11 whereby the latter may be set into rotation. When the lower frame body 5 has been lowered to the doffing position shown in FIGS. 2 and 3, the bobbin rail 6 is separated and lowered from the conveyor rail 7 while the tubular portion 10*a* is lowered to below the lower surface of the conveyor cover 8 for disengaging the bobbin 11 from the bobbin driving shaft 10.

Figure 3:
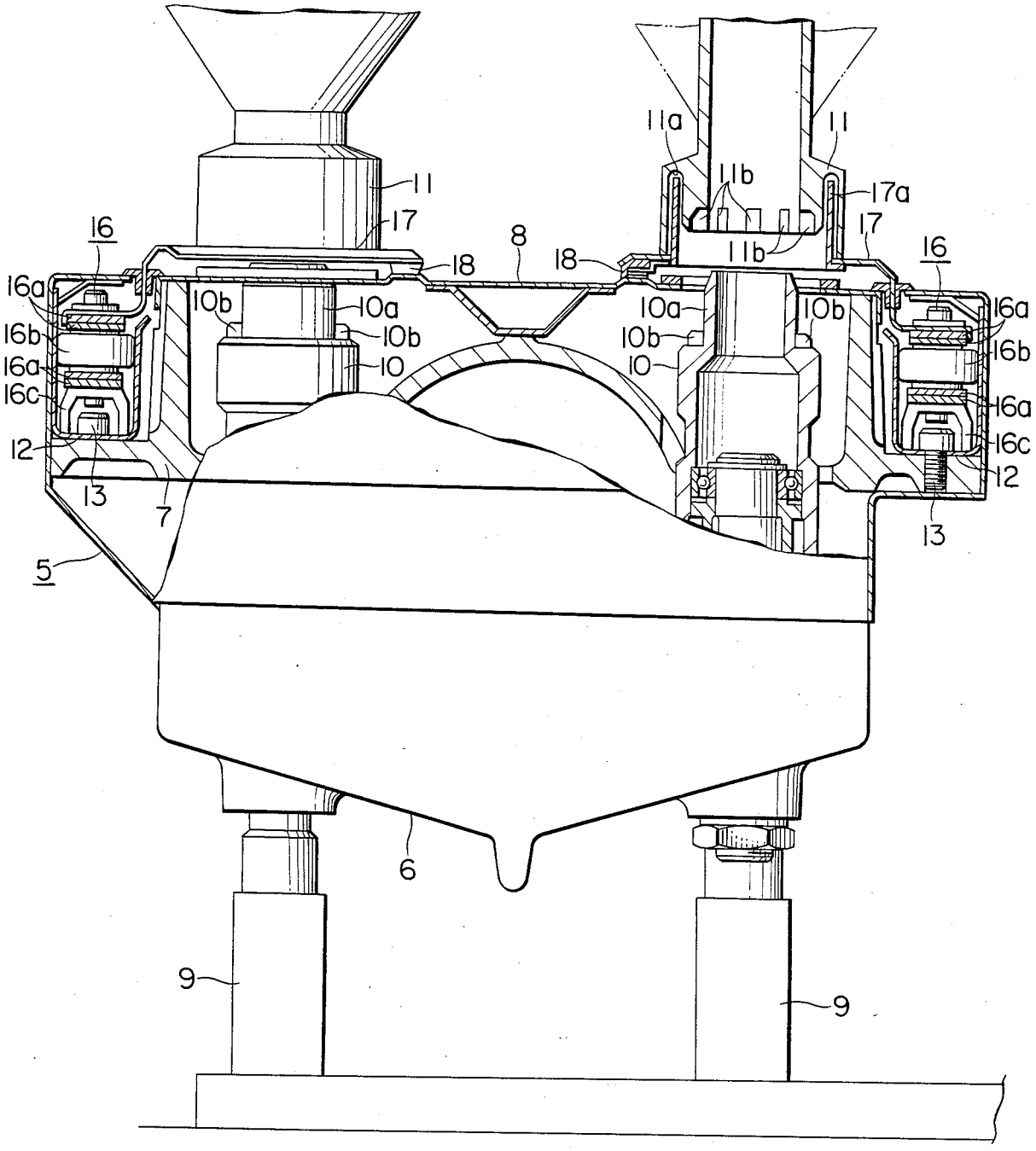
FIG. 3 is an enlarged view showing the framwork shown in FIG. 2, a part thereof being broken away.
Figure 4:
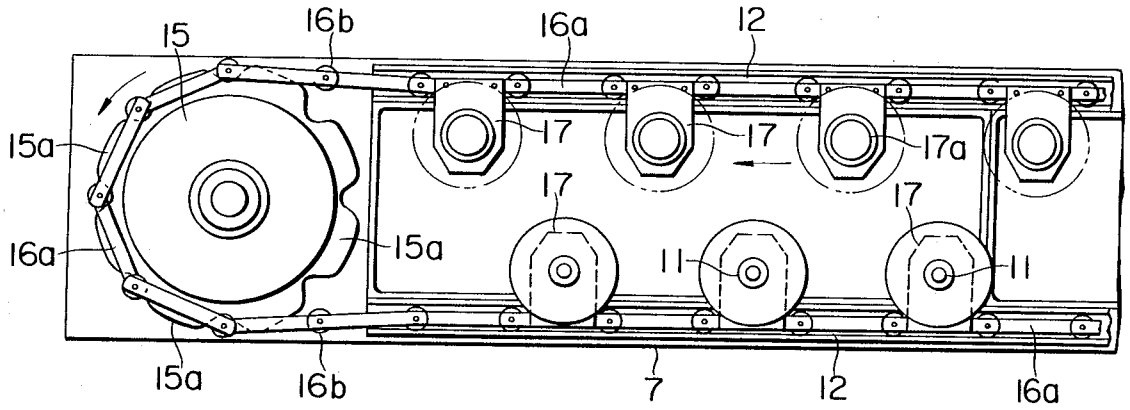
FIG. 4(*a*) is a schematic plan view showing the upper left-hand surface of a conveyor means, with the conveyor cover removed.
Figure 4:
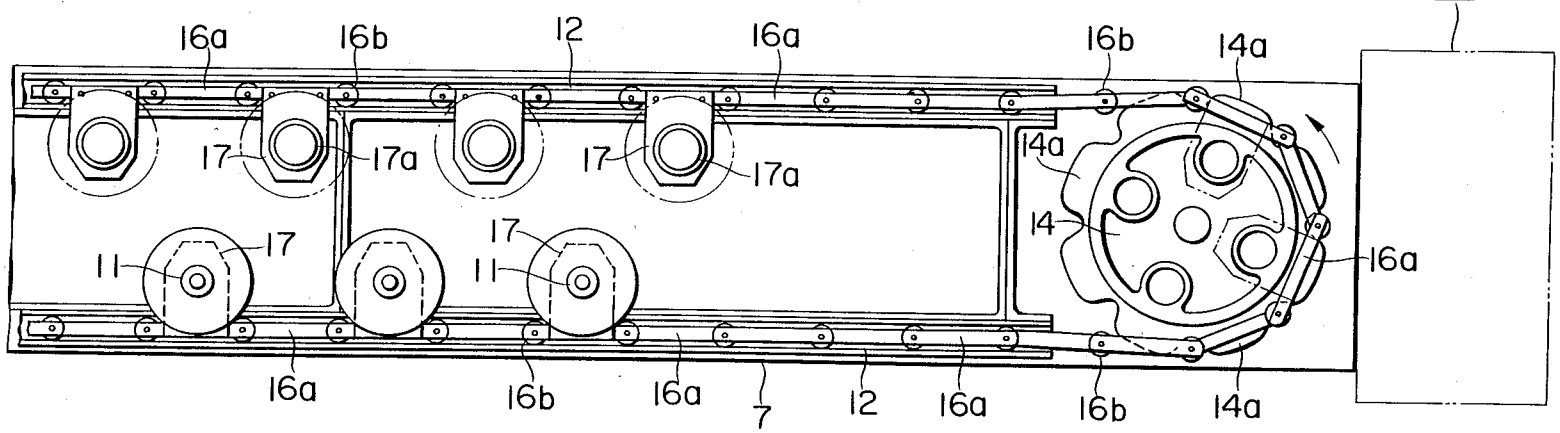

As shown in FIGS. 3, 4(*a*) and 4(*b*), a pair of conveyor guide rails 12 each having a substantially U-shaped cross-section are secured by plural bolts 13 to front and rear edges of the upper surface of the conveyor rail 7 of the lower frame body for extending substantially the overall length of the conveyor rail 7. A driving sprocket 14 having a large number of peripheral claws 14*a* is rotatably mounted on the right-hand upper surface of the conveyor rail 7, whereas a driven sprocket 15 having a large number of peripheral claws 15*a* is rotatably mounted on the left-hand upper surface of the conveyor rail 7 (FIG. 4*b*). An endless chain conveyor 16 placed between these sprockets 14, 15 is slidably mounted within the conveyor guide rails 12 and moved in an horizontal endless path or track with rotation of the driving sprocket 14 in the direction of the arrow mark shown in FIGS. 4(*a*) and 4(*b*).

The chain conveyor 16 is comprised of a large number of slat-like chain links or segments 16*a* arranged in an upper row and a lower row and pivotally connected at the ends to one another, a large number of rollers 16*b* interposed for free rotation at the connecting portions between adjacent chain segments 16*a*, and legs 16*c* secured to the lower connecting sides of the segments 16*a*. The claws 14*a*, 15*a* of the sprockets 14, 15 are engaged between the upper and lower rows of the chain segments 16*a*.

A large number of bobbin holders 17 are secured at outer ends thereof to selected ones of chain segments 16*a* of the chain conveyor 16 at intervals coincident with the distance between adjacent bobbin driving shafts 10. As shown in FIG. 3, each bobbin holder 17 extends through an associated one of the through-holes in the conveyor cover 8 of the lower frame body 5 and is longitudinally slidably supported on the upper surface of the conveyor cover 8 by an integral slider 18. When the chain conveyor 16 is halted for a yarn winding operation, bobbin supporting tubes 17*a* projectedly mounted to bobbin holders 17 are disposed concentrically with respect to the rotational axes of the bobbin driving shafts 10, as shown in FIGS. 3, 4*a* and 4*b*. When the lower frame member 5 is lowered for doffing as shown in FIGS. 2 and 3, the totality of bobbins 11 are disengaged simultaneously from the supporting tubular portions 10*a* of driving shafts 10 and are placed on associated ones of bobbin holders 17, with bobbin supporting tubes 17*a* engaged in lower annular grooves 11*a* of the associated bobbins 11.

Figure 5:
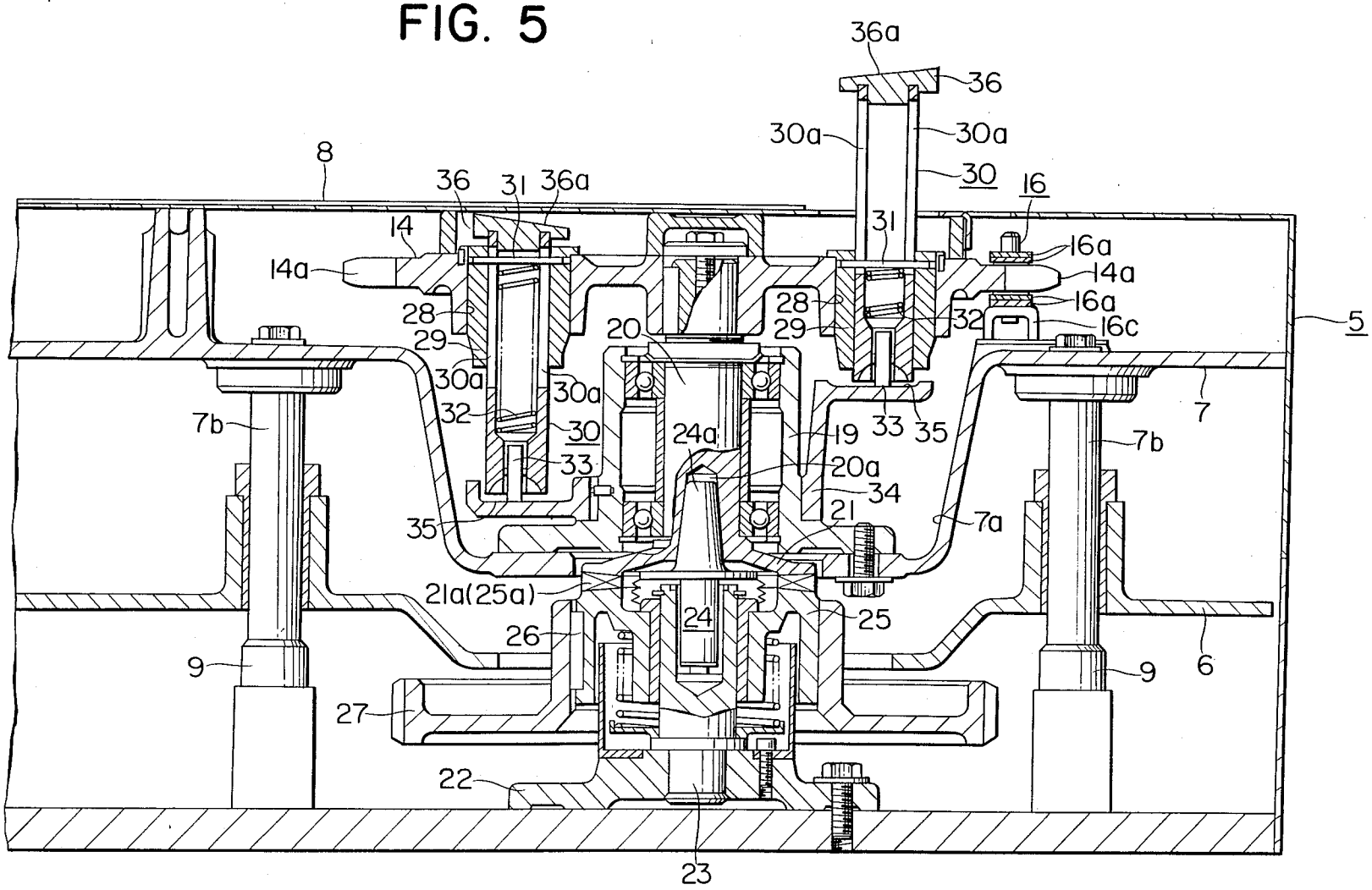
FIGS. 5 and 6 are enlarged longitudinal sectional views showing the driving section and the bobbin discharge section of the conveyor means.
Figure 6:
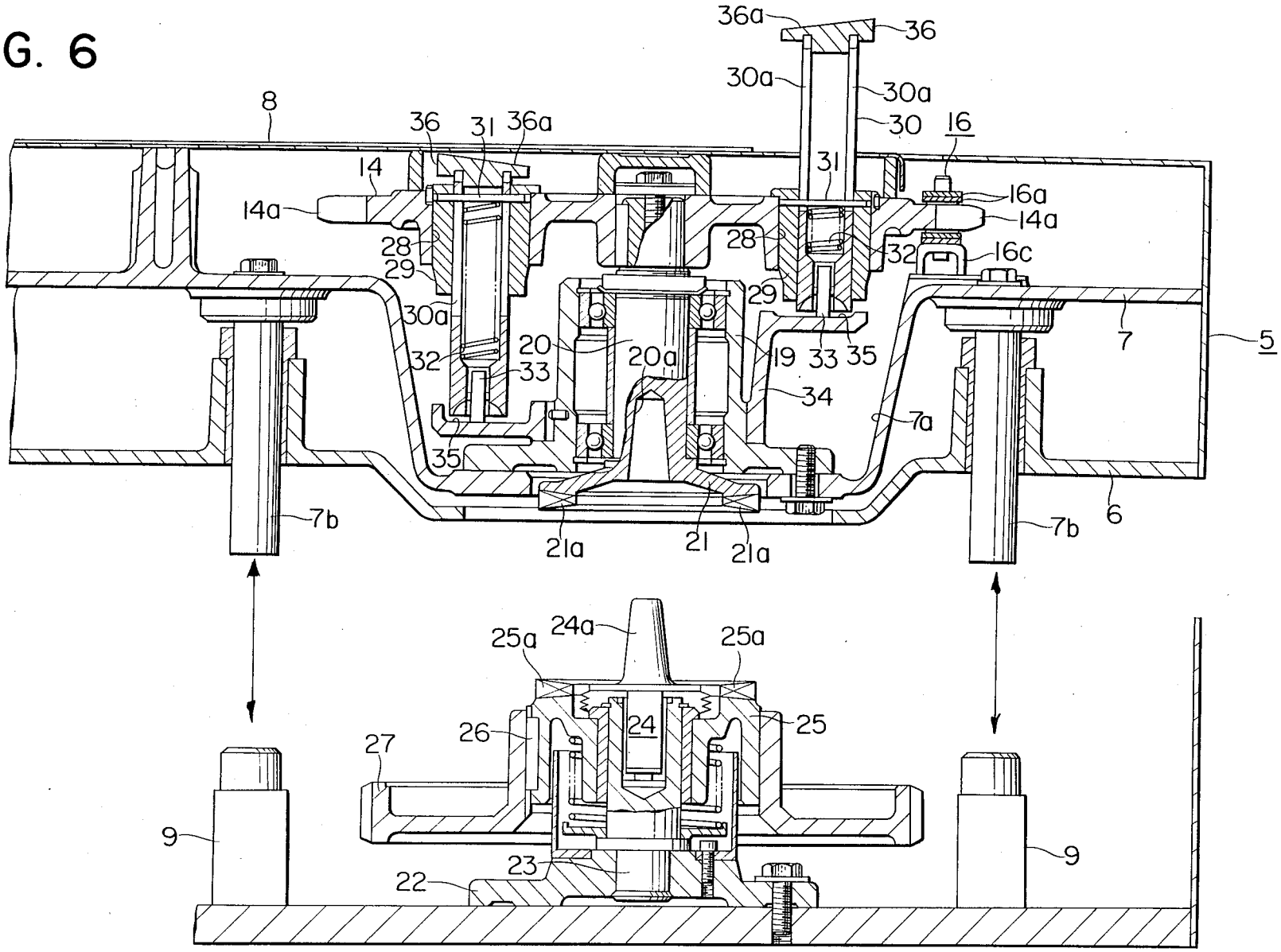
Figure 8:
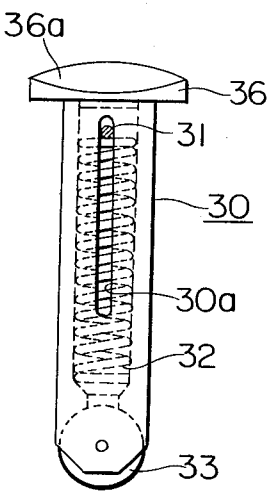
FIG. 8 is an enlarged side elevation of the projection piece.

In FIGS. 5 and 6, there is shown a conveyor driving unit adapted for rotating the driving sprocket 14. The unit is made up of a driven section provided to the lower frame body 5 and a driving section provided to the lower portion of the flyer frame for connection to and disconnection from the driven section. The driven section, in turn, is made up of a supporting tube 19 secured in a recess 7*a* on the upper surface of the conveyor rail 7, a driven shaft 20 rotatably journaled in the tube 19 and having a lower tapered opening 20*a*, and a clutch disc 21 inegrally mounted to the lower periphery of the driven shaft 20. The clutch disk 21 is passed via a through-opening in the bottom of the recess 7*a* and has a number of claws 21*a*. The aforementioned driving sprocket 14 is secured to the upper end of the driven shaft 20 for rotation in unison therewith.

The driving section is mounted to the stationary lower portion of the flyer frame and is made up of a supporting shaft 23 mounted on the upper surface of a mounting block 22 secured to the stationary flyer frame portion concentrically with the axis of the driven shaft 20, a connecting shaft 24 secured to said supporting shaft 23 and having an engaging base 24*a* associated with the engaging opening 24*a*, a clutch member 25 supported for rotation around and vertical movement relative to said supporting shaft 23 by bearing means, not shown, and having a number of claws 25*a* adapted for cooperation with claws 21*a* of the clutch disc 21, and a driving gear supported by slide key 26 for vertical movement relative to the outer periphery of the clutch member 25 and driven in rotation by a driving source, such as motor, not shown, through suitable reduction gearing, also not shown. When the lower frame body 5 is lowered for doffing as shown in FIG. 5, the engaging boss 24*a* on the upper end of the connecting shaft 24 is engaged into the tapered opening 20*a* of the driven shaft 20, while the driven clutch disc 21 is coupled with the driving clutch member 25. Thereafter, as the driving gear 27 is rotated, rotation is transmitted to the driving sprocket 14 associated with the driving section so that the chain conveyor 16 is driven in the direction of the arrow mark in FIGS. 4(*a*), 4(*b*).

The bobbin discharge unit for disengaging the bobbins 11 from the bobbin holders 17 is hereinafter described.

Figure 7:
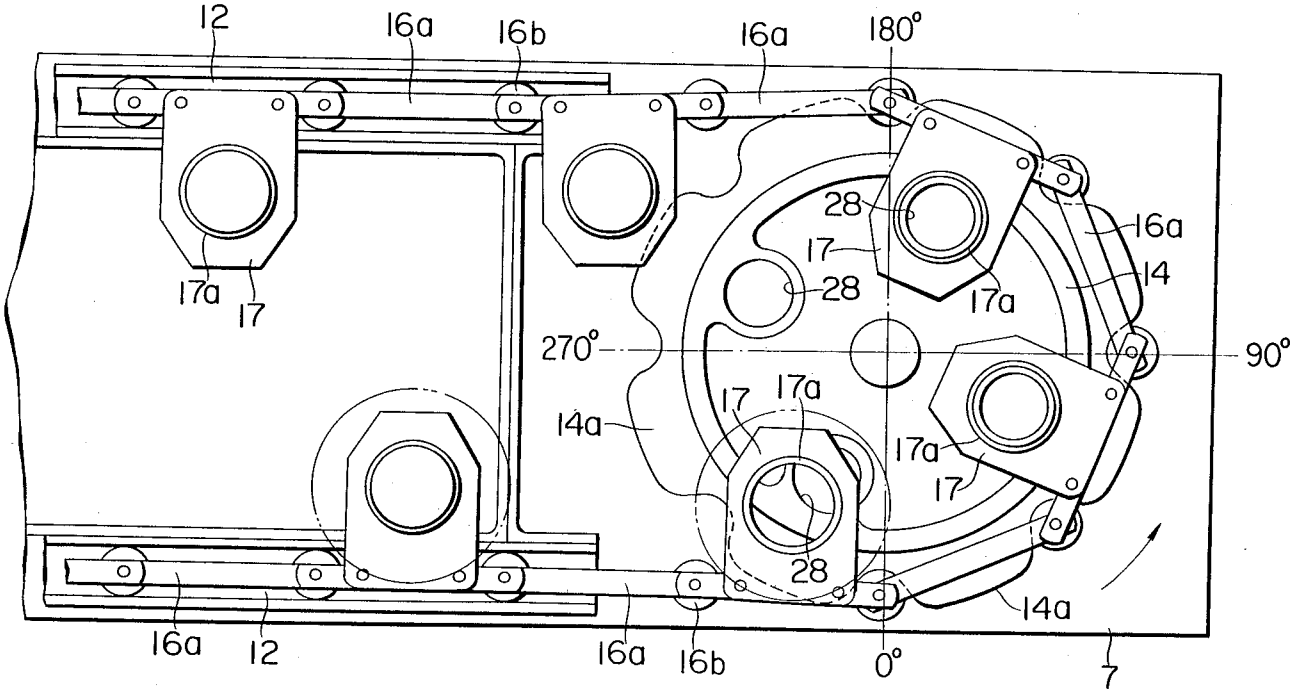
FIG. 7 is an enlarged plan view showing the driving sprocket.

The driving sprocket 14 is provided with plural (herein four) equiangular mounting holes 28 so that the bobbin supporting tubes 17*a* on the bobbin holders 17, as they pass around the upper surface of the driving sprocket 14 with movement of the chain conveyor 16, are axially aligned with the mounting holes 28 within an angular extent from 0° to 180° shown in FIG. 7. In each of these mounting holes 28, there is mounted, via a fixed sleeve 29, a projection piece 30 in the form of a bottomed cylinder. The projection piece 30 has vertically extending diametrically opposite slits 30*a* through which is passed a pin 31 mounted across the upper edges of the sleeve 29. The projection piece 30 may be guided vertically by the pin 31. A coil spring 32 is placed between the upper surface of the bottom of the projection piece 30 and the lower surface of the pin 31 so that the projection piece 30 is biased down by the spring 32.

On the lower end of each projection piece 30, there is mounted a roller 33, which is turnably abutted on a cam surface 35 of a cam member 34 fitted in turn to the lower periphery of the supporting tube 19. The cam surface 35 is formed in succession with an ascending slope surface, a higher horizontal surface, a descending slope surface and a lower horizontal surface, when seen in the direction of rotation of the driving sprocket 14 or in the direction from 0° to 360° in FIG. 7. With rotation of the driving sprocket 14, the roller 33 provided on the bottom of the projection piece 30 rolls on cam surface 35 so that each projection piece 30 may be projected from and receded into the driving sprocket 14 under or against the resiliency of the associated coil spring 32.

The profile of the cam surface 35 is so selected that the projection piece 30 starts to be projected from the driving sprocket 14 at or near 0°-position in FIG. 7 and brought to its uppermost position at or near 45°-position. With the projection piece 30 in this uppermost position, an engaging plate 36 fitted and secured to the upper end of the projection piece 30 acts to bias the bobbin 11 on the bobbin holder 17 to its uppermost position for disengaging the bobbin 11 from the associated bobbin holder 17. The upper surface of the engaging plate 36 secured to the upper end of the piece 30 is designed as an inclined surface with a downward gradient towards the sprocket 14, so that the bobbin 11 thus biased to its uppermost position may be inclined from the associated bobbin holder 17.

Figure 9:
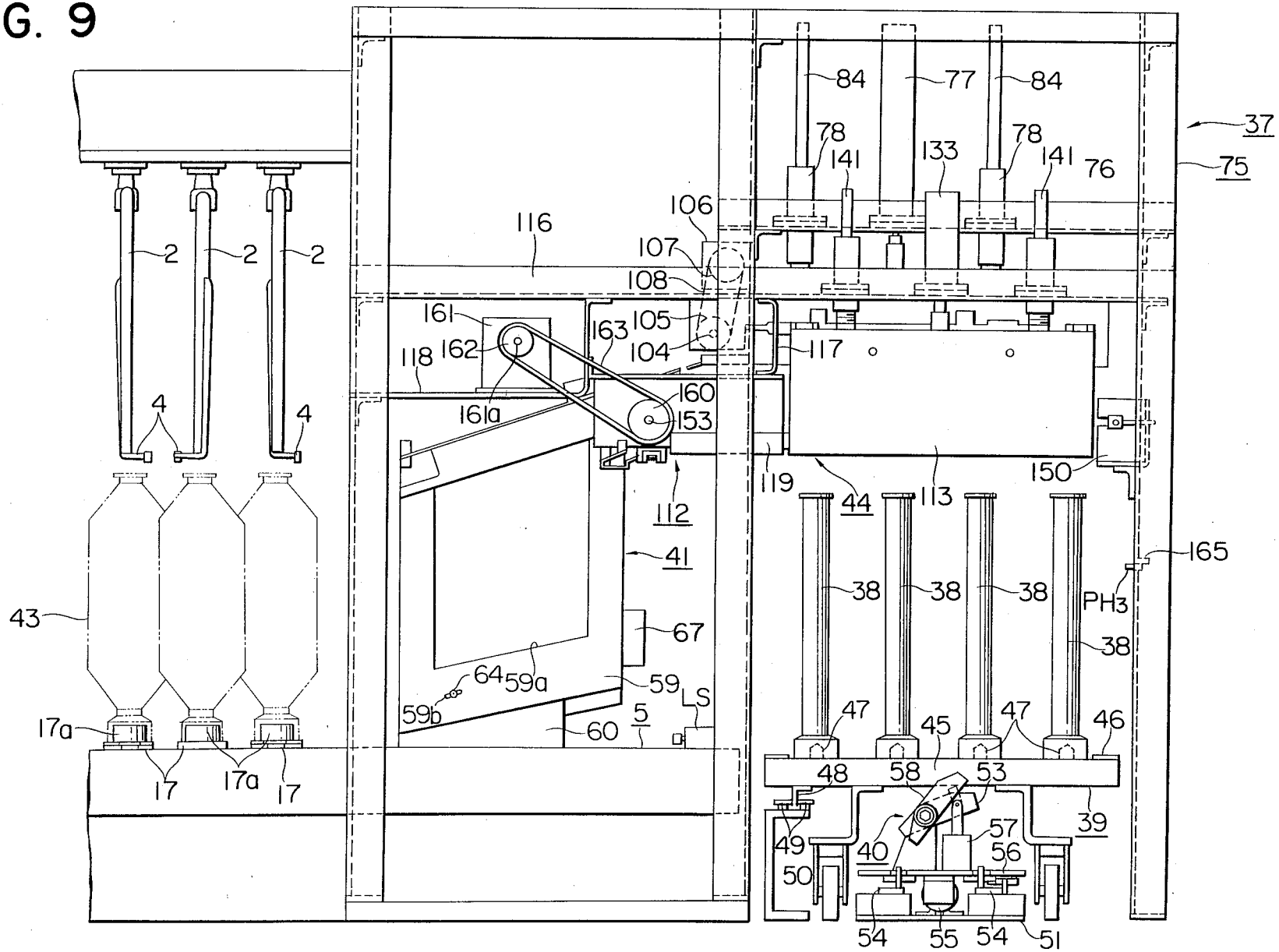
FIG. 9 is a front view of the bobbin exchange unit.
Figure 10:
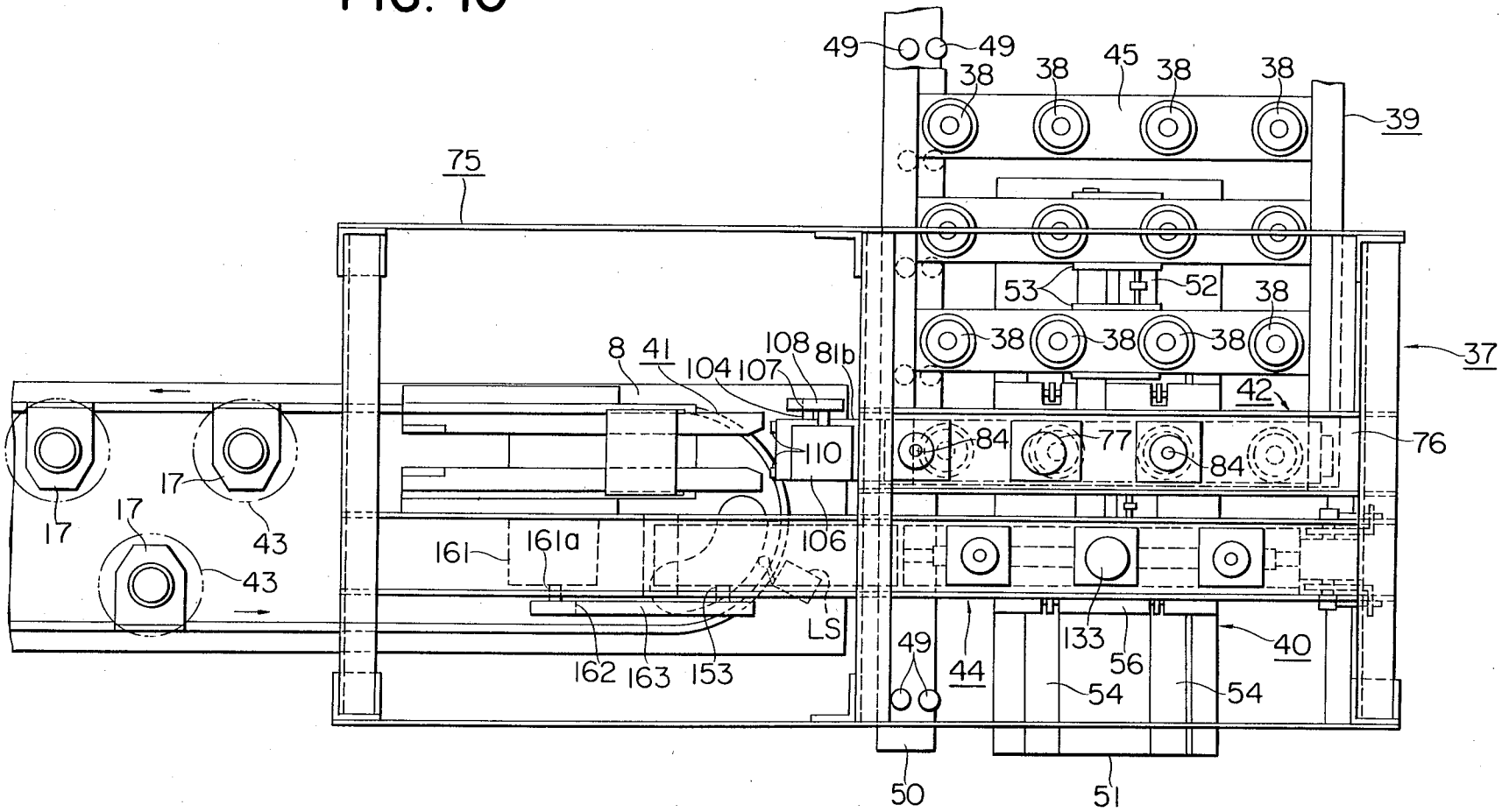
FIG. 10 is a plan view thereof.

A bobbin exchange unit 37 by means of which full yarn packages fresh from the flyer frame are shifted to a truck and transferred to the next process in upright position and empty bobbins are supplied one after another to empty bobbin holders 17 from which the full yarn packages have been discharged, is hereinafter described. As shown in FIGS. 4*b*, 9 and 10, this exchange unit 37 is provided at the right hand side of the stationary flyer frame portion and has an intermittent feed section 40, an empty bobbin transport section 42 and a full yarn package transfer section 44. The section 40 is adapted to receive the truck 39 on which empty bobbins 38 are mounted in upright position in plural equidistant rows each of which is composed of a predetermined number of empty bobbins, and to shift the truck intermittently in a direction perpendicular to the longitudinal direction of the flyer frame and by a distance equal to the row pitch each time. The transport unit 42 operates to take out a row of empty bobbins 38 maintained in upright position at a time and transfer them to an empty bobbin supply box 41 from which the empty bobbins 38 are separately supplied to associated bobbin holders 17. The full yarn package transfer section 44 is mounted adjacent to the empty bobbin transport section 42 and operates in such a manner that the full yarn package 43 disengaged from the bobbin holder 17 by the operation of the bobbin discharge mechanism is held in upright position and transferred to a position above the truck 39 to be placed on the truck 39 in a predetermined number each time by descent of the transfer section 44.

The truck 39 is made up of a plurality of horizontally mounted tubular members 45 secured on both ends to fixed plates for providing a loading section 46. Four pegs 47 are mounted at equal intervals on the upper surfaces of the members 45. A regulating or control plate 48 is mounted in the fore and aft direction to the lower surface of the loading section 46. To the right hand side of the stationary flyer frame portion, a rail 50 is mounted extending in the fore and aft direction of the stationary flyer frame portion and carries a large number of guide rollers 49 adapted in turn to be engaged by the control plate 48 to control the transverse movement of the truck 39 and to guide the latter to travel in a direction perpendicular to the longitudinal direction of the flyer frame.

Figure 11:
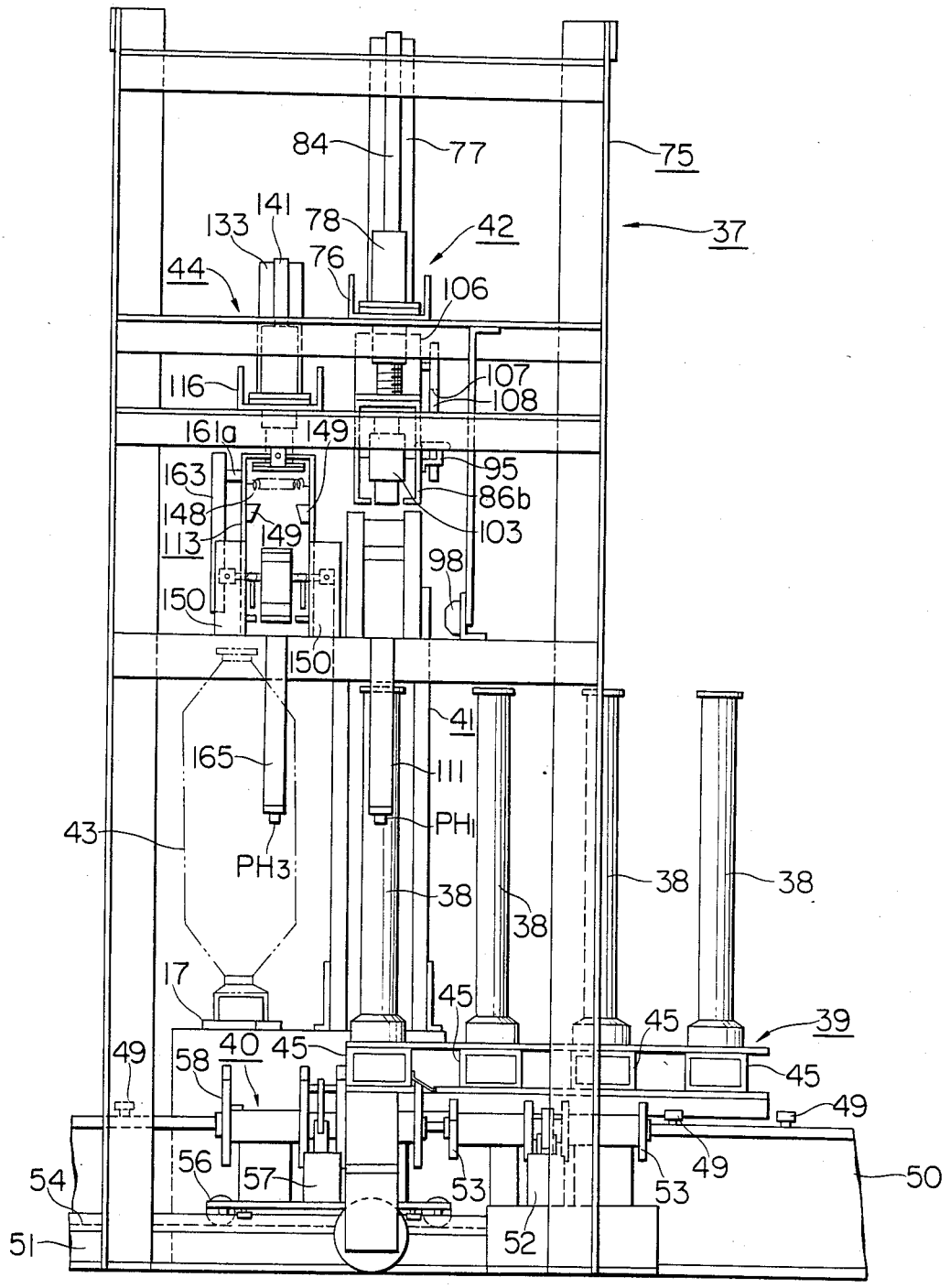
FIG. 11 is a side elevation thereof.

As shown in FIGS. 9, 11, the intermittent feed section 40 is made up of two pairs of truck securing levers 53, a movable member 56 and two pairs of rotary levers 58. The truck securing levers 53 are rotatably mounted by pivot shaft mounted on the base 51 provided on the rail 50 and rotated by solenoid 52 between a position engaging the tubular member 45 of the truck 39 and a position not engaging therewith. The movable member 56 is reciprocated by operation of a cylinder 55 on guide rails 54 secured to the base 51 in parallel with the rail 50. The two pairs of rotary levers 58 are pivotally mounted by pivots provided on the movable member 56 and are rotated by operation of the cylinder 57 between a position engaging the tubular member 45 of the truck 39 and a position not engaging therewith. With the levers 58 rotated to the unengaging position and the rotary levers 53 rotated to the engaging position, the movable member 56 is moved in the forward direction by the cylinder 55. With the levers 53 rotated to the engaging position and the levers 58 to the unengaging position, the movable member 53 is moved in the reverse direction by the cylinder 55. In this manner, the truck 39 may be fed intermittently by an interval equal to the pitch of the tubular members 45 each time.

Figure 12:
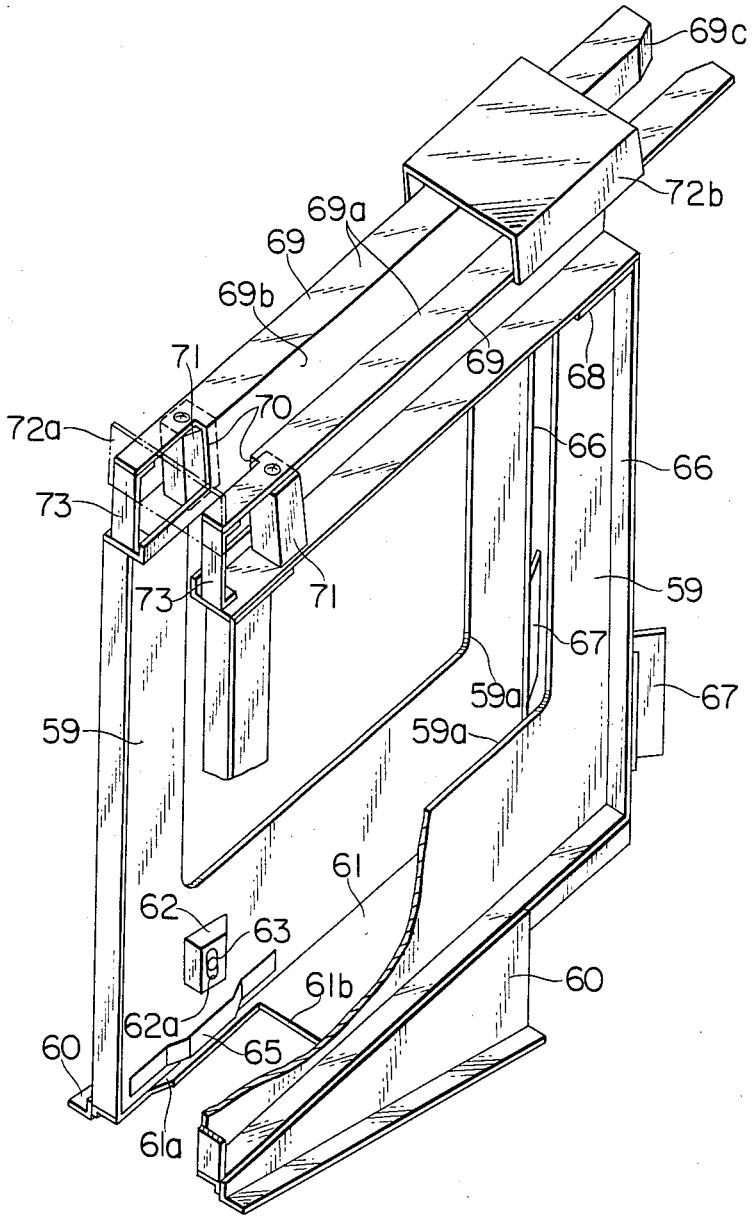
FIG. 12 is a perspective view showing an empty bobbin supply box, with a part thereof being broken away.
Figure 13:
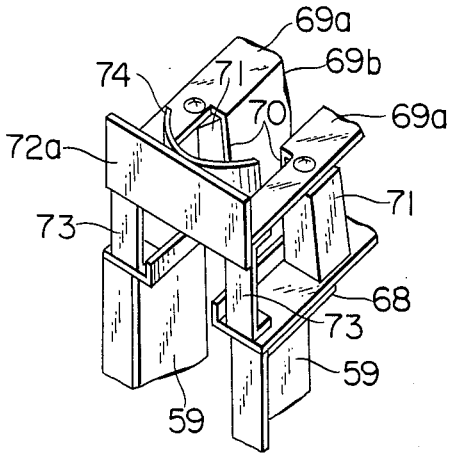
FIG. 13 is an enlarged perspective view showing an upper foremost part of the empty bobbin supply box.

Referring to FIG. 10, the empty bobbin supply box 41 is mounted on the conveyor cover 8 parallel to the longitudinal direction of the flyer frame and is designed to perform a vertical movement in unison with the oonveyor rail 7, in such a manner that the center of the bobbin supporting tube 17*a* of the bobbin holder 17 may pass through the center of the box 41 during operation of the chain conveyor 16. The box 41 is approximately parallelogrammic and comprised of a pair of side walls 59 each having a parallelogrammic through-hole 59*a*, mounted on a bottom wall 61 in parallel with each other and with a gap somewhat larger than a larger diameter section 33*a* of the empty bobbin 33. The bottom wall 61 is secured, as shown in FIG. 12, to a pair of mounting legs 60 with a descending slope towards the proceeding direction of the chain conveyor 16. A pair of engaging pieces 62 for engaging with the larger diameter section 38*a* of the empty bobbin 38 are securely mounted to the lower forward inner surfaces of the side walls 59. Each engaging piece 62 has a stepped long aperture 62*a*, and its associated side wall 59 has a long aperture 59*b* through which is passed a bolt 63 having a nut 64 (see FIG. 9) for adjustably securing the piece 62. A plate spring 65 is mounted to the lower forward inner surface of one of side walls 59 for pressing and holding the larger diameter section 38*a* of the empty bobbin 38 as it is guided through the empty bobbin supply box 41. A pair of vertically extending mounting plates 66 are rigidly mounted to rear ends of side walls 59 while a pair of guide plates 67 are mounted to lower parts of mounting plates 66 for guiding the larger diameter section 38*a* of the empty bobbin 38 into the space between the side walls 59.

Figure 14:
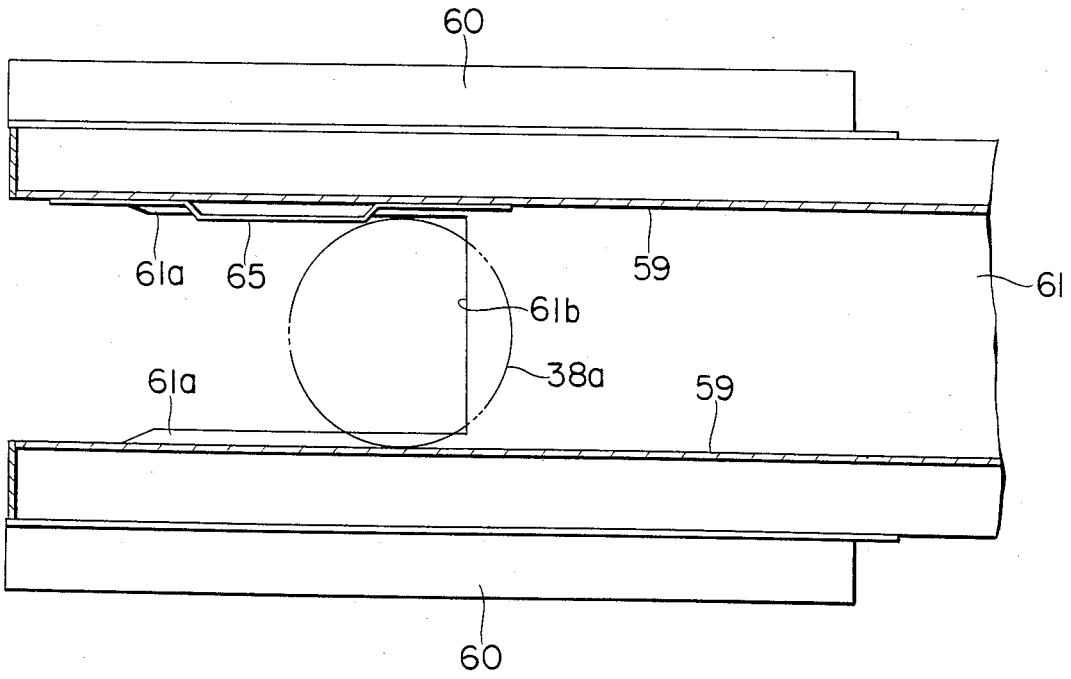
FIG. 14 is an enlarged partial cross sectional view of the empty bobbin supply box.

As shown in FIGS. 12, 14 a pair of supporting rim portions 61*a* supporting the larger diameter section 38*a* of the empty bobbin 38 are formed on lower ends of the bottom wall 61, while a recess 61*b* is also formed to permit the passage of the bobbin supporting tube 17*a* of the bobbin holder 17.

A pair of mounting portions 68 are bent on the upper rim portions of the side walls 59 with a gradient approximately equal to that of the bottom wall 61. To the upper surface of the mounting portion 68 is rigidly mounted a guide member 69 having a U-shaped cross-section and provided with a guide surface 69*a* engaging an upper flange 38*b* of the empty bobbin 38 for suspendedly guiding the empty bobbin 38, and a guide surface 69*b* for guiding the lesser diameter yarn winding section of the bobbin 38, in such a manner that the interval between the guide surfaces is slightly larger than the diameter of the yarn winding section. In the forward portions of the guide sections 69, a pair of cut-outs or recesses 70 are formed to permit downward travel of the flange 38*b*, and a pair of engaging members 71 are secured to close the rear ends of the recesses 70. A supporting plate 72*a* is rigidly mounted to the forward portions of the guide members 69 at right angles therewith via mounting brackets 73. An arcuate guide plate 74 is securely mounted to the center of the supporting plate 72*a* for inhibiting forward travel of, and for downwardly guiding the flange 38*b* being slid along the guide surface 63*a*. The upper parts of the guide members 69 are extended beyond the rear ends of the side walls 59 as rear extensions 69*c*. The guide members 69 are connected together by a connecting plate 72*b* for maintaining a constant interval between the side walls 59 and the guide sections 62.

Figure 15:
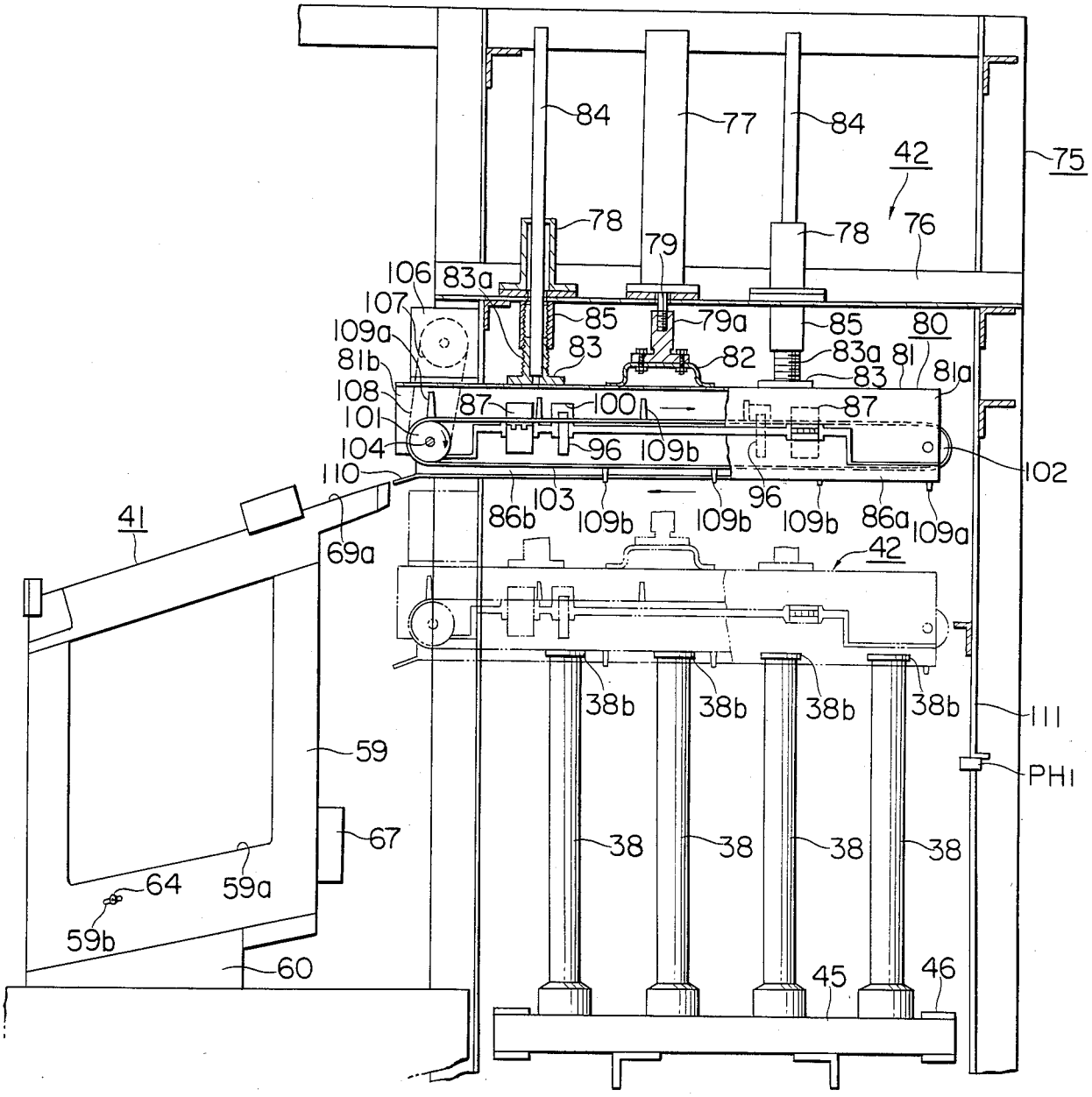
FIG. 15 is a front view showing the empty bobbin transport device, a part thereof being broken away.

The empty bobbin transport unit 42 for taking out empty bobbins 38 from the truck 39 and transferring them to the supply box 41 is hereinafter explained. As shown in FIGS. 9 through 11, the unit 42 is mounted on a frame 75 on the right hand side of the flyer frame so as to lie above the truck 39, which travels along the rail 50, and vertically aligned with the mounting position of the bobbin supply box 41. A supporting frame 76 is mounted on the upper part of the frame 75 at right angles to the rail 50 and a cylinder 77 is mounted upright centrally on the upper surface of the frame 76. A pair of guide tubes 78 are securely mounted in parallel with and on both sides of the cylinder 77. As shown in FIG. 15, a mounting bracket 79*a* is threadedly mounted on the end of a piston rod 79 associated with the cylinder 77.

Figure 16:
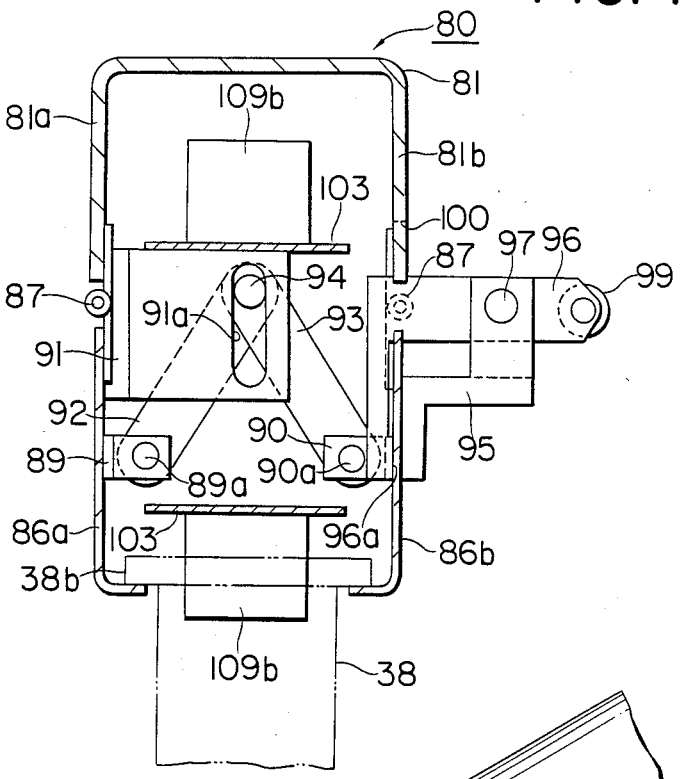
FIG. 16 is a cross sectional view showing the empty bobbin suspension unit.
Figure 17:
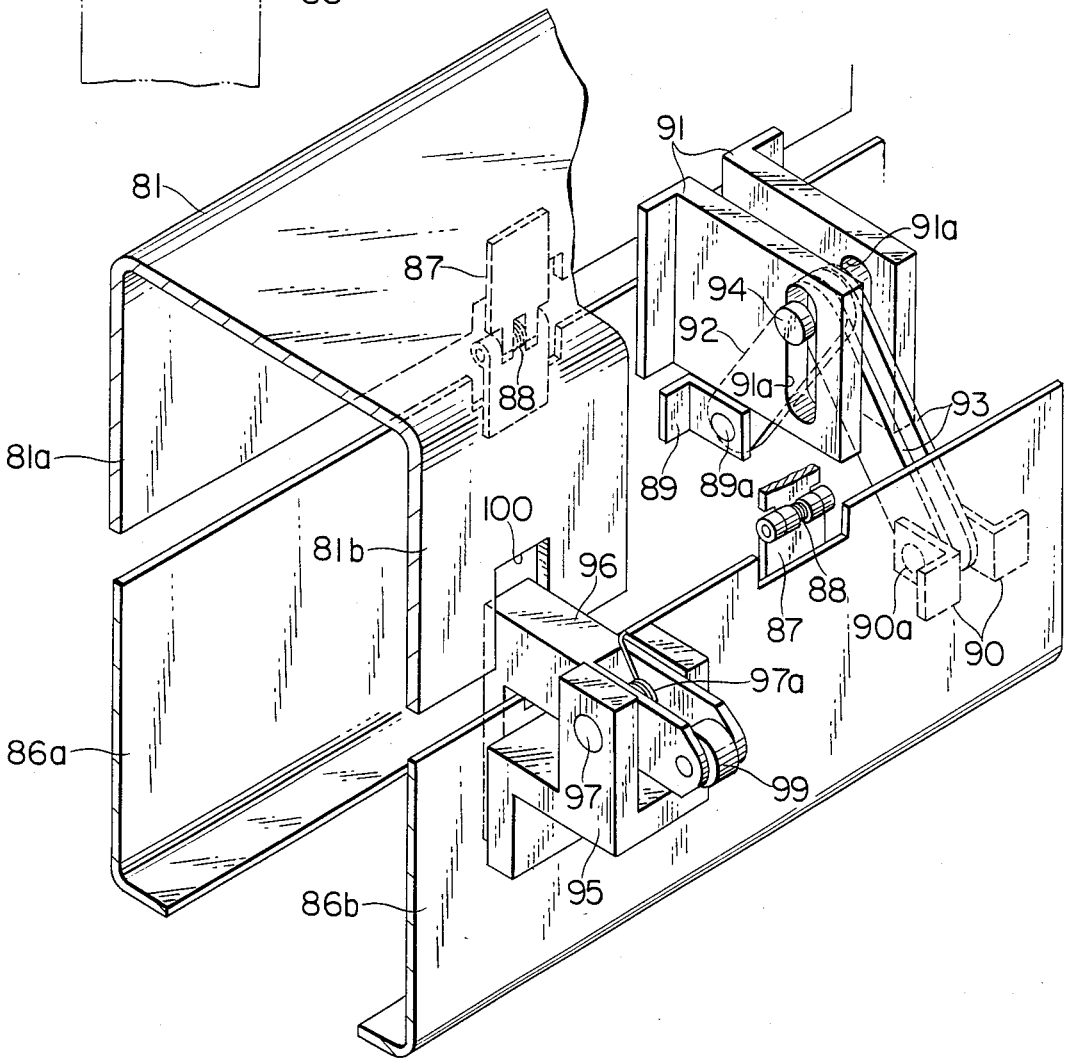
FIG. 17 is an enlarged perspective view showing essential elements, with a part thereof being broken away.

An empty bobbin suspension unit 80 shown in FIGS. 16 and 17 has a supporting member 81 which is horizontally secured by bolts and nuts to the mounting bracket 79*a* via mounting plate 82 which in turn is secured to the upper surface of the supporting member 81, as shown in FIG. 15. The supporting member 81 is bent in the shape of an inverted letter U and is longer in length than the tubular member 45 of the truck 39. A guide rod 84 inserted into the guide tube 78 has its base end fitted into a supporting tube 83 which is in turn secured to the upper surface of the supporting member 81 in register with the guide tube 78. The supporting tube 83 has a male thread 83*a* threadedly engaged with a regulating or control tube 85 abutting in turn on the lower surface of the supporting frame 76 and regulating the upward travel of the supporting member 31.

A pair of guide rails 86*a*, 86*b*, bent at their lower ends inwardly for engaging with the lower surface of the flange 38*b* for suspending an empty bobbin 38, are rotatably connected by each of two hinges 87 respectively to a front wall 81*a* and a rear wall 81*b* of the supporting member 81 and are biased to rotate inwards by torsion springs 88. A pair of supporting brackets 89, 90 are secured to the inner surfaces of the guide rails 86*a*, 86*b* for respectively supporting shafts 89*a*, 90*a* extending in turn parallel to the longitudinal direction of the guide rail. A pair of control brackets 91 are securely mounted to the front wall 81*a* above the supporting bracket 89. These brackets 91 are secured at the upper ends thereof to the lower inner surface of the front wall 81*a* in order to be engaged with the inner surface of one of the guide rails 86*a* connected to the front wall 81*a* to control inward rotation thereof, with one end of the control brackets 91 extending to the inner side of the guide rail 86*a*. The brackets 91 are provided with vertically extending long slots 91*a* centrally between guide rails 86*a*, 86*b*. A lever 92 and a pair of levers 93 are pivotally carried by the shafts 89*a*, 90*a* at one of their ends and are pivotally connected to each other at the other by a connecting pin 94 introduced into slots 91*a* in the control brackets 91.

A pair of brackets 95 are secured to the outer surfaces of the guide rail 86*b* connected to the rear wall 81*b*, only one bracket being shown. An L-shaped lever 96 is pivotally mounted to the bracket 95, as shown in FIGS. 16 and 17, by shaft 97, in such a manner that the inner corner thereof lies adjacent to the upper end of the guide rail 86*b* and the side of the letter L lies alongside the inner surface of the guide rail 86*b*. The lever 96 is biased to rotate counterclockwise in FIGS. 16 and 17 by a torsion spring 97*a* wound about shaft 97. This rotation is normally limited by an engaging projection 96*a* on one side of the lever 96, disposed within the guide rail 86*b*, which abuts on the inner surface of the guide rail 86*b* in such a manner that the other side is maintained at right angles with the guide rail 86*b*. To the projecting end of the lever 96, there is mounted, as shown in FIG. 11, a cam roller 99 adapted for engaging with a cam 98 arranged below the supporting frame 76. A cut-out or recess 100 is provided in the rear wall 81*b* and in register with the lever 96 in order to permit clockwise rotation of the lever 96 in FIGS. 16 and 17.

As shown in FIG. 15, a driving pulley 101 and a driven pulley 102 are rotatably mounted on the left and right hand sides of the supporting member 81, and a toothed belt 103 is installed between driving and driven pulleys 101, 102. A rotary shaft 104 carrying the driving pulley 101 is protruded partially out of the rear wall 81*b* and a pulley 105 is fitted on the projected end of the shaft 104. On the upper left-hand surface of the supporting member 81, there is mounted an electric motor 106, and a belt 108 is placed between the pulley 105 and a pulley 107 fitted on the driving output shaft of the motor 106. Thus, rotation of the motor 106 is transmitted to the rotary shaft 104 through pulley 107, belt 108 and pulley 105. In this manner, the driving pulley 101 is rotated clockwise in FIG. 15, resulting in shifting the toothed belt 103 in the direction of the arrow mark in FIG. 15.

On the outer periphery of the toothed belt 103, there are projectedly mounted engaging pieces 109*a*, 109*b* that may engage with flange 38*b* of the empty bobbin 38 suspended between guide rails 86*a*, 86*b*. Referring to the engaging pieces 109*a*, 109*b*, in the dwell position of the toothed belt, as shown in FIG. 15, the four engaging pieces 109*a*, 109*b* of one set are arranged at equal distance from one another in such a manner that the four empty bobbins 38 suspended between guide rails 36*a* and 36*b* and the aforementiond engaging pieces 109*a*, 109*b* are alternately positioned relative to one another. Thus, when the toothed belt 103 has travelled one half its overall stroke, the four empty bobbins 38 suspended from the guide rails 86*a*, 86*b* are discharged from the guide rails 86*a*, 86*b*. In order to positively stop the toothed belt 103 at the predetermined position, the rearmost engaging piece 109*a* looking in the proceeding direction of the toothed belt 103 is longer than the remaining three pieces 109*b*. The foremost part of the engaging piece 109*a* is sensed by a photocell, not shown, provided on the inner side of the supporting member 81. The signal issued from the photocell is effective to halt the operation of the motor 106.

A guide piece 110 having the same slope as that of the guide surface 69*a* of the guide member 69 of the empty bobbin supply box 41 is integrally formed with the lower left side of the guide rails 86*a*, 86*b*. In the present embodiment, the upper surface of the guide piece 110 can be easily positioned flush with the guide surface 69*a* by adjusting, during assembly, the length of threaded engagement of the foremost part of the piston rod 79 with the mounting bracket 79*a* and that of the control tube 85 with the male thread 83*a* of the control tube 85.

A reflective type photocell PH1 is mounted via a bracket 111 to the right side of the frame 75 and in registry with the mounting position of the empty bobbin supply box 41, for sensing the empty bobbin 38 transported by the truck 39. The output signal from the photocell PH1 is effective to drive the cylinder 77 into operation.

The full yarn package transfer section is hereinafter explained. As shown in FIGS. 9 through 11, the section 44 is mounted ahead of and in parallel with the empty bobbin transport section 42 and in such a manner that the center-to-center distance between the two sections is the same as that between the tubes 45 on the truck 39. The full yarn package transfer section is made up of a full yarn package holding device 112, a full yarn package inserting device 113 and a full yarn package transport device 114. The holding device 112 is operative to temporarily support and hold the full yarn package 43 in upright state upon release thereof from the associated bobbin holder 17 by the aforementioned bobbin discharge unit. On the other hand, the inserting device 113 operates to support the packages 43 by its flange 43*b* and to insert a predetermined number of packages 43 (four packages in the present embodiment) onto pegs 47 on the truck 39 as the device 113 is lowered, and the device 114 operates to transport the full yarn packages supported by the device 112 to the inserting device 113.

Figure 18:
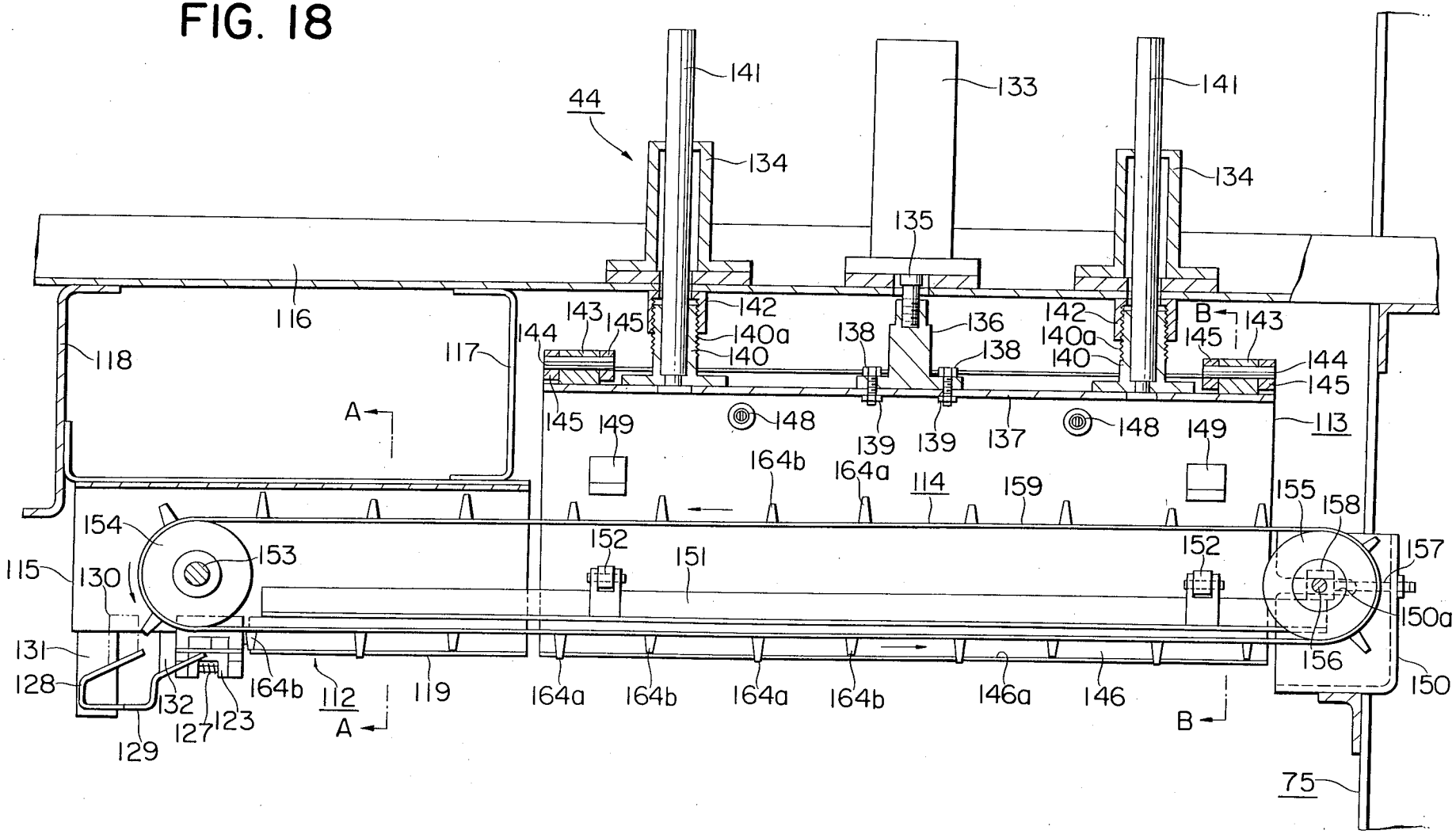
FIG. 18 is a longitudinal section through a full yarn package transfer device.
Figure 19:
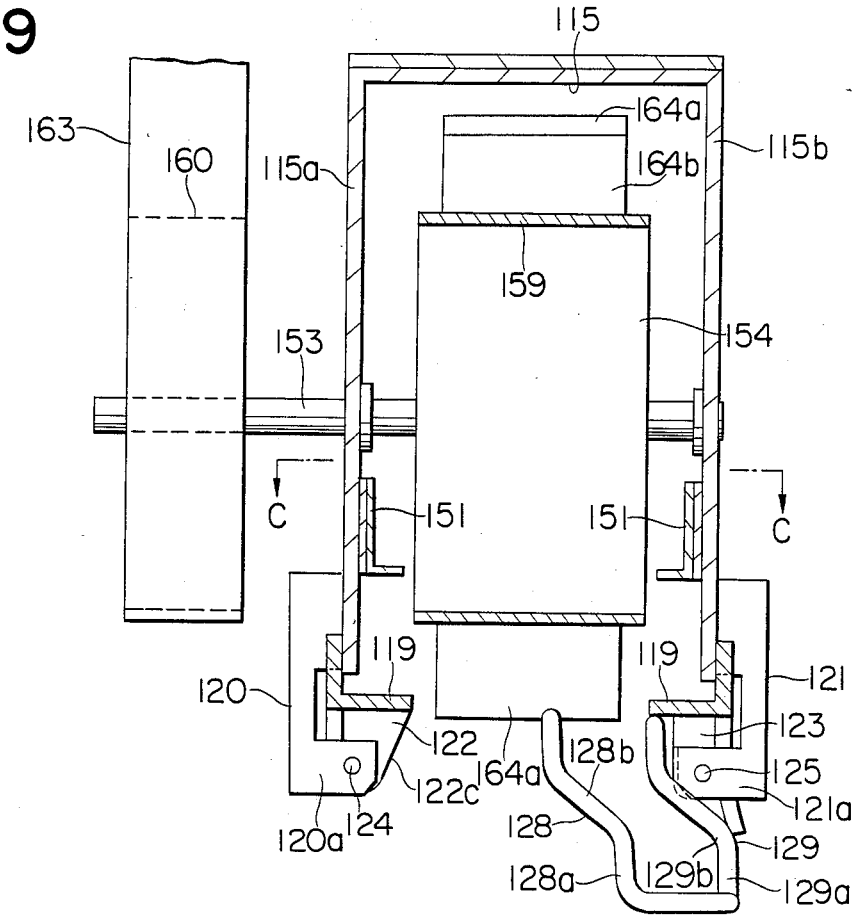
FIG. 19 is an enlarged sectional view taken along line A—A of FIG. 18, with certain parts being omitted.
Figure 21:
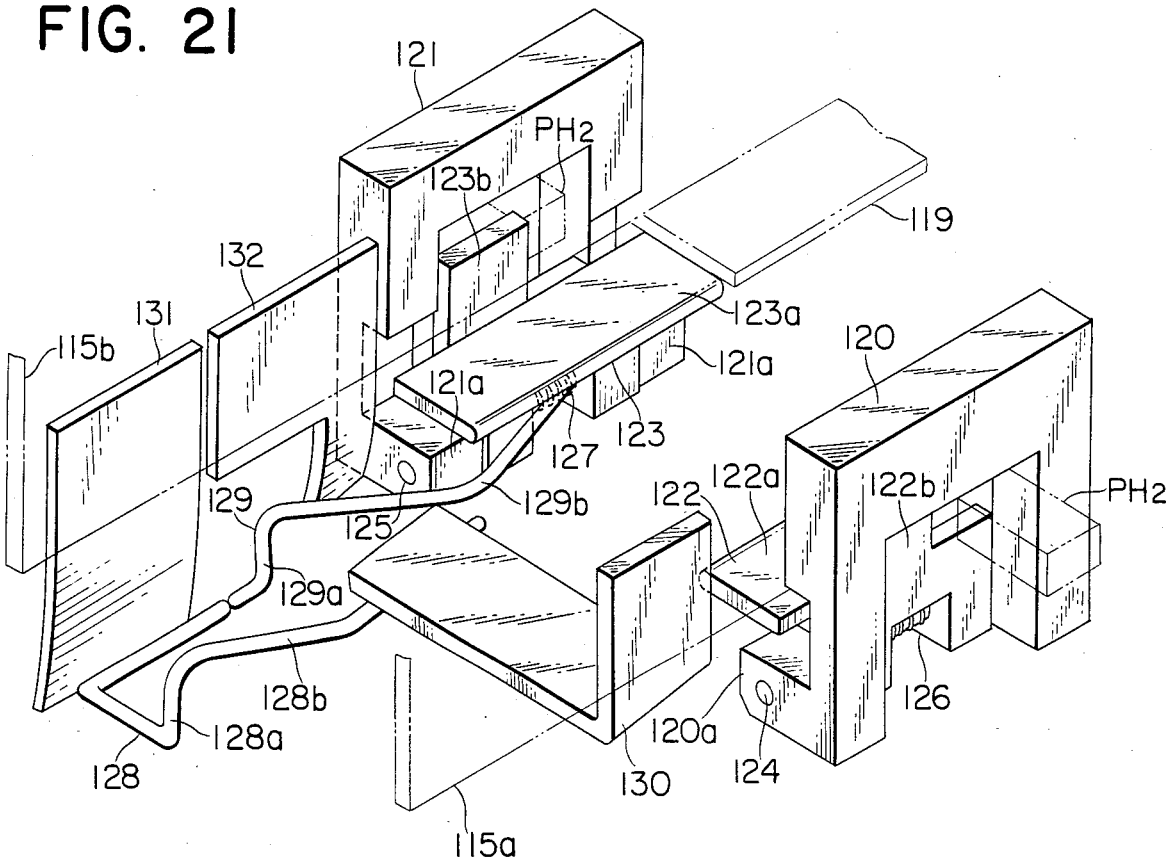
FIG. 21 is an enlarged perspective view showing essential elements of the full yarn bobbin holding device.

As shown in FIGS. 18, 19, the full yarn package holding device 112 is comprised of a supporting member 115 having a U-shaped cross-section and rigidly mounted via brackets 17, 18 to the lower surface of the supporting frame 116 in parallel with the longitudinal direction of the flyer frame. A pair of rails 119 extending from about the center to the right side end of the supporting member 115 are rigidly mounted to the lower outer surface of a front wall 115*a* and a rear wall 115*b* of the supporting member 115, for suspending the full yarn packages 43 at their flanges 43*b*. A pair of supporting brackets 120, 121 are rigidly mounted to the lower outer surfaces of the front and rear walls 115*a*, 115*b* in proximity to the rails 119. Journal units 120*a*, 121*a* spaced apart from each other a distance slightly larger than the diameter of the flange 43*b* are projectedly mounted opposite to each other to the lower ends of the supporting brackets 120, 121. Journal members 122, 123 for clamping and holding full yarn packages 43 in upright position are rotatably supported on journal units 120*a*, 121*a* by shafts 124, 125 extending parallel to the rails 119. As shown in FIGS. 19, 21, journal members 122, 123 are provided with journal surfaces 122*a*, 123*a* for journaling the lower surface of the flange 43*b* of the full yarn package 43 and mating portions 122*b*, 123*b* lying at right angles to the journal surfaces 122*a*, 123*a*. The journal members 122, 123 are usually maintained in a horizontal position by torsion springs 126, 127 wound about said shafts 124, 125, in such a manner that said mating portions 122*b*, 123*b* abut on the outer surfaces of the front and rear walls 115*a*, 115*b* respectively and the journal surfaces 122*a*, 123*a* are maintained flush with the upper surfaces of the rails 119. The foremost parts of journal surfaces 122*a*, 123*a* of the journal members 122, 123 are extended to the level of the foremost parts of the rails 119. One member 122 of the supporting members is provided with an inclined cam surface 122*c* continuing from the lower end of the member 122 to the foremost part of the journal surface 122*a*. A pair of photocells PH2 (shown in FIG. 21) are provided on the supporting brackets 120, 121 for sensing the flange 43*b* guided on the upper surface of the journal surfaces 122*a*, 123*a*.

Figure 20:
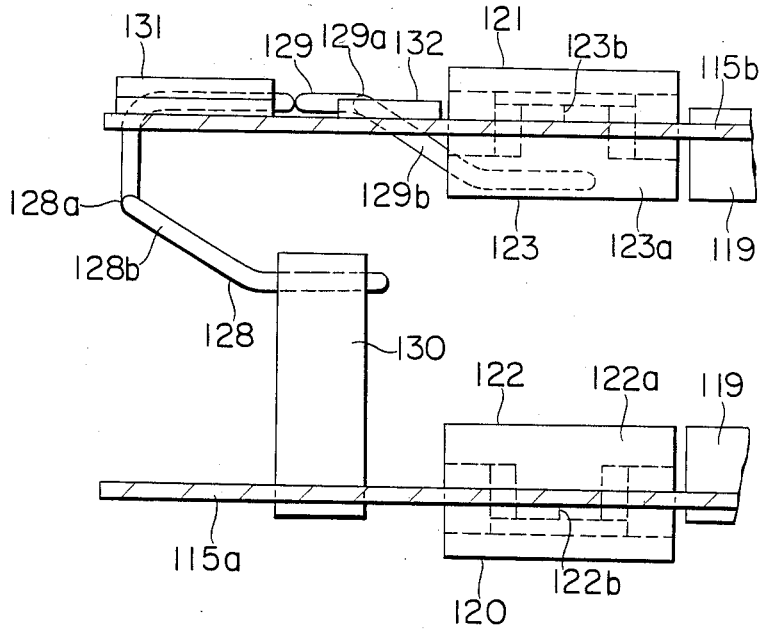
FIG. 20 is a sectional view taken along line C—C in FIG. 19, with certain parts being omitted.

To the left-hand end of the supporting member 115, a pair of guide bars 128, 129 are mounted for supporting the flanges 43*b* of full yarn packages 43 discharged by the bobbin discharge section from associated bobbin holders 17 and guiding said flanges 43*b* to the journal members 122, 123. As shown in FIGS. 18, 19, 20, the guide bar 128 is securely mounted to end parts of brackets 130, 131 securely mounted in turn to the front wall 115*a* and rear wall 115*b*. An upright portion 128*a* of the guide bar 128, abutted by the periphery of the flange 43*b* of the full yarn package 43 tilted by the action of the bobbin discharge mechanism, is positioned away from the rear wall 115*b* a distance substantially equal to about one-fourth the distance between the front wall 115*a* and the rear wall 115*b*. The upright portion 128*a* is contiguous to an inclined portion 128*b* which is extended obliquely upward towards a mid point intermediate the front wall 115*a* and the rear wall 115*b* for guiding the upper surface of the flange 43*b*. It is then bent at the mid point and extended further upwards in parallel with the rear wall 115*b*.

The other guide bar 129 is rigidly mounted to the supporting bracket 121 and a bracket 132 secured to the outer surface of the rear wall 115*b*. The guide bar 129 has an upright portion 129*a* disposed below the rear wall 115*b* for supporting the peripheral surface of the flange 43*b* of the tilted full yarn package 43 in cooperation with the upright portion 128*a* of the guide bar 128. Contiguous to the upright portion 129*a* is an inclined portion 129*b* extending to the foremost part of the journal unit 121*a* of the supporting bracket 121 with the same slope as that of the inclined portion 128*b* for guiding the lower surface of the flange 43*b*. The guide bar 129 is bent at said foremost part of the journal unit 121*a* where it is bent and further extended to the central lower surface of the journal surface 123*a* in parallel with the rear wall 115*b*.

As shown in FIG. 18, the full bobbin package inserting device 113 is mounted in proximity to the righthand end of the full yarn package holding device 112. A cylinder 133 is rigidly mounted upright on the supporting frame 116, and a pair of guide tubes 134 are rigidly mounted on both sides of and parallel to the cylinder 133. A mounting bracket 136 is threadedly attached to the end of a piston rod 135 associated with the cylinder 133, and a mounting plate 137 is securely mounted by bolts 138 and nuts 139 to the lower surface of the mounting bracket 136 so as to lie in the longitudinal direction of the flyer frame. A pair of guide tubes 140 are securely mounted on the upper surface of the mounting plate 137 in register with the guide tubes 134, and the ends of guide rods 141 which are inserted into the guide tubes 134 are fitted into supporting tubes 140. Each supporting tube 140 has a male threaded portion 140*a*, to which is threaded a regulating or control tube 142, abutting in turn on the lower surface of the supporting frame 116 for regulating upward travel of the mounting plate 137.

Figure 22:
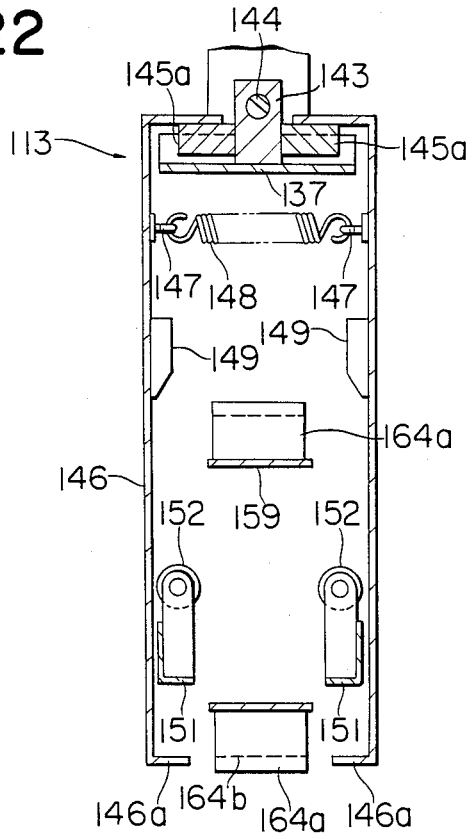
FIG. 22 is an enlarged sectional view taken along line B—B of FIG. 18.
Figure 23:
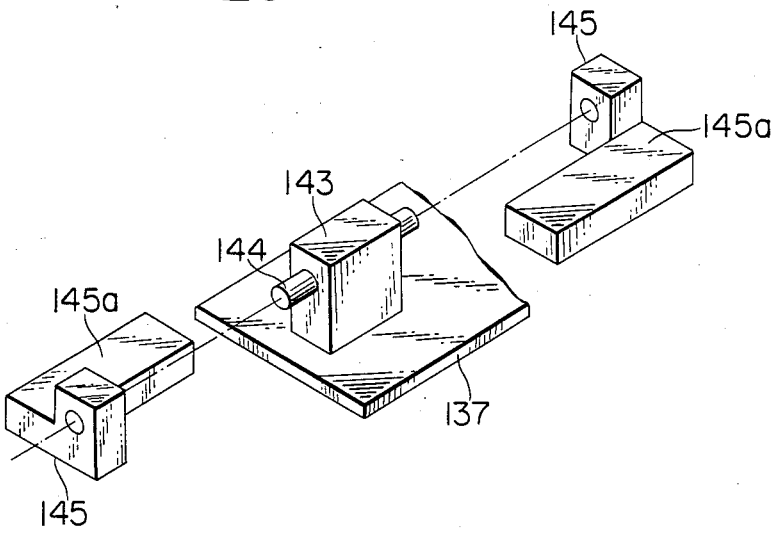
FIG. 23 is an exploded perspective view showing the mounting of the mounting pieces to the mounting plate.
Figure 24:
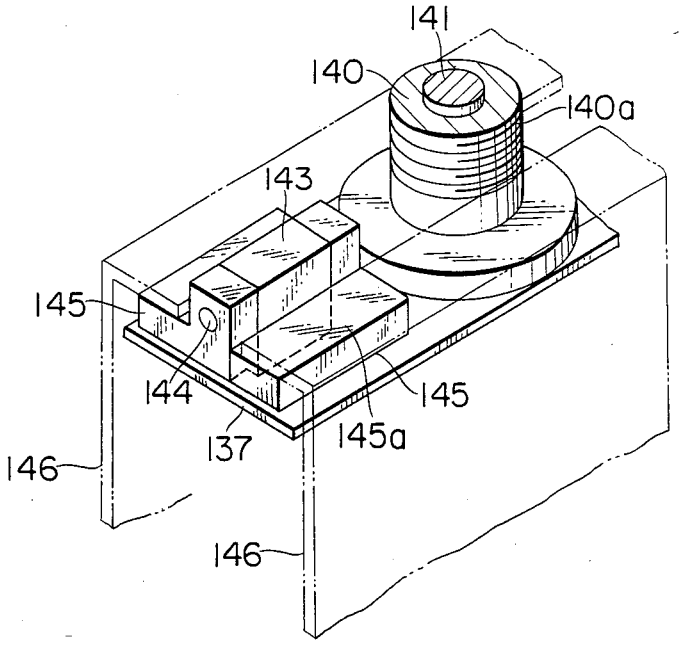
FIG. 24 is a perspective view showing essential elements used for securing rails.

A pair of supporting brackets 143 are rigidly mounted to both sides on the upper surface of the mounting plate 137. A supporting shaft 144 is fitted to each said supporting bracket 143 in such a manner that the shaft 144 is extended longitudinally of the mounting plate 137 and both ends thereof are projected out of the supporting bracket 143. A pair of mounting pieces 145 are rotatably supported on the projecting parts of each supporting shaft 144. As shown in FIGS. 22, 24, the supporting pieces 145 are supported in such a manner that the lower surfaces thereof are spaced apart from the upper surface of the mounting plate 137 and the inner sides of mounting parts 145*a* abut on the supporting brackets 143. A pair of rails 146, each having the same length as that of the mounting plate 137 and having a lower bent edge 146*a* for supporting full a yarn package 43, is securely mounted, by an upper bent edge thereof, to the upper surface of the associated mounting piece 145. It is critical that the upper surface of the lower bent edge 146*a* be flush with the upper surface of the associated rail 119 of the full yarn holding device 112. In the present embodiment, threaded engagement of the piston rod 135 with the mounting bracket 136 and threaded engagement of the control tube 142 with the male threaded portion 140*a* of the supporting tube 140 are controlled during assembly for positioning the upper surface of the bent edge 146*a* at the same height as the upper surface of the rail 119.

Two pairs of hooks 147 are mounted to the upper inner sides of the rails 146 and a tension spring 148 is placed between these hooks 147. A pair of end cams 149 are provided on the upper inner surface of the rails 146. A pair of mounting bars 151 having an L-shaped cross-section are mounted to the lower inner sides of rails 146 and secured to the inner sides of a pair of brackets 150 (forward and rear brackets) rigidly mounted in turn to the front and rear walls 115*a*, 115*b* of the supporting member 115 at one of its ends and to the frame 75 at the other of its ends. The mounting bar 151 is mounted in the longitudinal direction of the rail 146 in close proximity to the inner surface of the rail. Two pairs of cam rollers 152 are rotatably mounted in register with associated cams 149.

The full bobbin package transport device 114 is hereinafter explained in more detail. A rotary shaft 153 is rotatably mounted to the inner left side of the front and rear walls 115*a*, 115*b* of the supporting member 115, and a driving pulley 154 is fitted to the shaft 153 for rotation therewith. On the brackets 150 provided on the right hand side of the rail 148, there is formed a groove 150*a* in the longitudinal direction of the rail 146. A supporting shaft 156 rotatably supporting the driven pulley 155 has its both ends passed through the groove 150*a*. The supporting shaft 156 has its both ends fitted to supporting members 158 attached to the foremost parts of a pair of adjustment bolts 157 in turn adjustably mounted along groove 150*a*. A toothed belt 159 is placed between pulleys 154, 155 and adjustable in tension by adjusting the projection of the adjustment bolts 157.

The end of the rotary shaft 153, to which is fitted the driving pulley 154, is projected, as shown in FIGS. 10, 19, to the outside of the front wall 115*a* of the supporting member 115, and is fitted with a pulley 160. An electric motor 161 is mounted on the upper surface of the bracket 118 mounted below the supporting frame 116 (FIG. 9) and a belt 163 is installed between a pulley 162 fitted on a driving shaft 161*a* of the motor and the pulley 160. The driving shaft 161*a* is connected via a clutch, not shown, to an output shaft, also not shown, of the motor 161, and can be braked by braking means, not shown. When the driving shaft 161*a* is rotated, such rotation is transmitted via pulley 162, belt 163 and pulley 160 to the rotary shaft 153, whereby the driven pulley 154 is rotated counterclockwise in FIG. 18 for shifting the toothed belt 159 in the direction of the arrow mark in FIG. 18.

On the outer periphery of the toothed belt 159, there are projectedly mounted engaging pieces 164*a*, 164*b* that may engage with flanges 43*b* of the full yarn packages 43 carried between journal members 122, 123, rails 119, 119 or between rails 148, 148. The engaging pieces 164*a* are longer than the engaging pieces 164*b* and the pieces 164*a*, 164*b* are arranged in an alternate fashion with a spacing between adjacent pieces 164*a*, 164*b* substantially equal to the diameter of the flange 43*b*. The toothed belt 159 is normally stopped in the dwell position with one of the shorter engaging pieces 164*b* lying in proximity to the right hand side of the journal members 122, 123 and, when the photocell PH2 has sensed that the flange 43*b* of the full yarn package 43 has been supported on the surfaces 122*a*, 123*a* of the journal members 122, 123 by the operation of the full yarn package discharge unit, and limit switch LS provided on the periphery of the bobbin holder 17 has engaged with the bobbin holder 17 and sensed that the holder 17 has arrived at a position whereat the full yarn package 43 is completely disengaged from the projection piece 30, the belt 159 is shifted a distance equal to the mounting pitch of the engaging pieces 164*a* by the operation of the driving shaft 161*a*. In order to positively stop the toothed belt 159 at a predetermined position, a photocell (not shown) is provided at a predetermined position for sensing the presence or absence of the foremost part of the longer piece 164*a* so that the photocell signal is effective to stop the operation of the driving shaft 161*a*.

Referring to FIGS. 9 and 11, a reflective type photocell PH3 is mounted via bracket 165 to the right hand side of the frame 75 for sensing that the full yarn package 43 intermittently transported on the rails 146 by the bobbin transport device 114 has arrived at the right hand side of the rails 146. The signal from the photocell PH3 is effective to activate the cylinder 133.

In the present embodiment, two limit switches (not shown) are provided for engaging with the truck 39 on the rail 50 adapted to guide the truck 39. The arrangement is much that only one limit switch is activated when the first row of the empty bobbins 38 has been transported to the position registered with the empty bobbin transport device 42, and both limit switches are activated when the second row et seq. of the empty bobbins 38 have been transported to the position registered with the empty bobbin transport device 42. In addition, the arrangement is such that, when only one limit switch is in operation, as mentioned hereinabove, the toothed belt 103 is driven during operation of the cylinder 77 of the empty bobbin transport device 42 and at the same time that recession of the piston rod 79 to a predetermined position has been confirmed, and that, when both of the limit switches are in operation, the toothed belt 103 is not driven simultaneously with confirmed recession of the piston rod 79, but is driven in accordance with output signals from photocell PH3.

The operation of the bobbin exchange unit 37, so far shown and described, is as follows.

When the roving has been taken up fully on bobbin 11 by the operation of the flyer frame, so that a full yarn package 43 is formed, the winding or take up operation ceases. The lower frame body 5, in the upper take-up position shown in FIG. 1, is lowered as one unit from the take up traverse range so that the spindles 3 of the respective flyers 2 are extracted in unison from the upper ends of the bobbins 11. At the instant that the lower faces of the guide rods 7*b* securely mounted to the conveyor rail 7 abut on stoppers 9, downward travel of the conveyor rail 7 is inhibited, so that only the bobbin rail 8 is separated from the conveyor rail 7 and further lowered. As a result, the bobbin driving shafts 10 inserted into bobbins 11 are lowered in unison with descent of the bobbin rail. The bobbins 11 are separated from their associated tubular portions 10*a* and placed on the bobbin holders 17 as the bobbins 11 remain inserted in the bobbin supporting tubes 17*a*.

When all of the full yarn packages 43 have thus been placed on the associated bobbin holders 17, the truck 39 is conveyed to one end of the flyer frame. Empty bobbins 38 have been previously placed on all of the pegs 47 of the truck. As the truck 39 is moved along rail 50, the foremost horizontal member 45 is engaged with the rotary lever 58 of the intermittent feed unit 40, and the empty bobbins 38 of the first row are positioned in register with the empty bobbin transport unit 42. With the empty bobbins 38 thus positioned in register with the transport section 42, photocell PH1 senses the empty bobbins 38 and the electric motor, not shown, is activated for driving the gear 27 based on the output signal from the photocell. As the gear 27 is driven into rotation, such rotation is transmitted via slide key 26, clutch member 25, clutch disc 21 and driven shaft 20 to the driving sprocket 14 for driving the chain conveyor 16. The bobbin holders 17 mounted on chain conveyor 16 are moved in the direction of the arrow mark in FIG. 10 with the full yarn packages 43 resting thereon. The motor is driven in rotation until all of the full yarn packages have been exchanged with empty bobbins, unless the exchange operation is terminated in case of an emergency.

Figure 26:
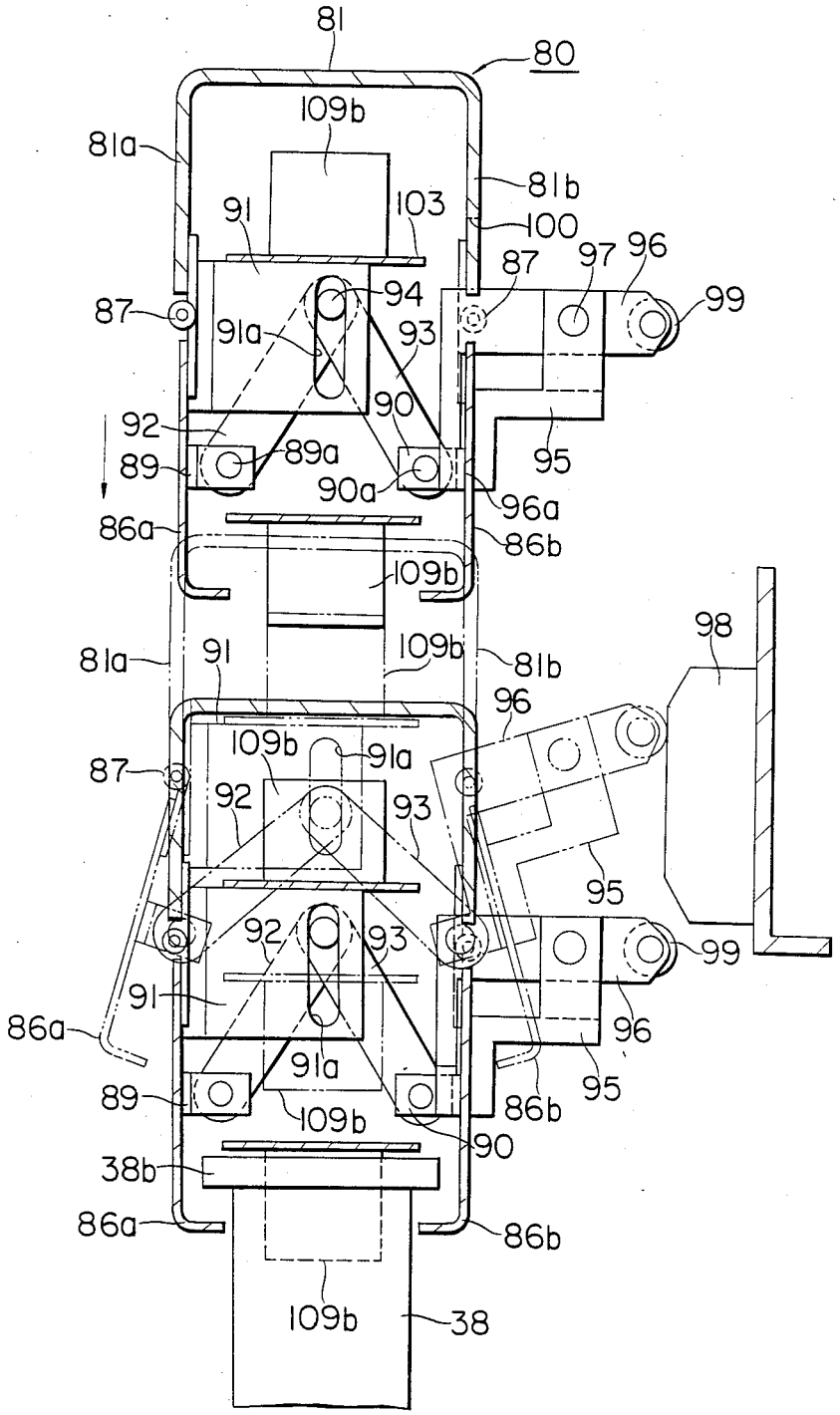

The cylinder 77 of the empty bobbin transport unit 43 is activated by the output signal from photocell PH1 and the piston rod 70 is lowered together with the bobbin suspension unit 80. Referring to FIG. 26, as the section 80 is lowered, and the cam roller 99, mounted on the rotary lever 96, in turn mounted via bracket 95 to the other guide rail 86*b*, abuts on cam 98, the rotary lever 96 is pushed upward and the other guide rail 86*b* is swung outwards about hinge 87 against the force of torsion spring 88 and as one with the lever 96 and bracket 95, as indicated by a double-dotted chain line in FIG. 26. As the guide rail 86*b* has turned outwards, the one end of the lever 93, whose one end is coupled via supporting shaft 90*a* to the supporting shaft 90, secured in turn to the inner surface of the guide rail 86*b*, is lowered by the connecting pin 94 along the long slot 91*a* in the control bracket 91. By the operation of the lever 92, connected via supporting shaft 89*a* to the supporting bracket 89, in turn connected at one end to the connecting pin 94 and at the other to the inner surface of the guide rail 86*a*, the guide rail 86*a* is also turned outwards about hinge 87 and against the force of the spring 88.

The guide rails 86*a*, 86*b* are lowered further from the position shown in the double-dotted chain line in FIG. 26 until the foremost parts of the guide rails pass by the flange 38*b* of the empty bobbin 38, while the cam roller 99 and the cam 98 are disengaged from each other. The guide rails 86*a*, 86*b* are turned inwards under the force of torsion spring 88 until the lower ends of the guide rails 86*a*, 86*b* are positioned below the flange 38*b*. At this time, the operation of the cylinder 77 ceases.

Figure 27:
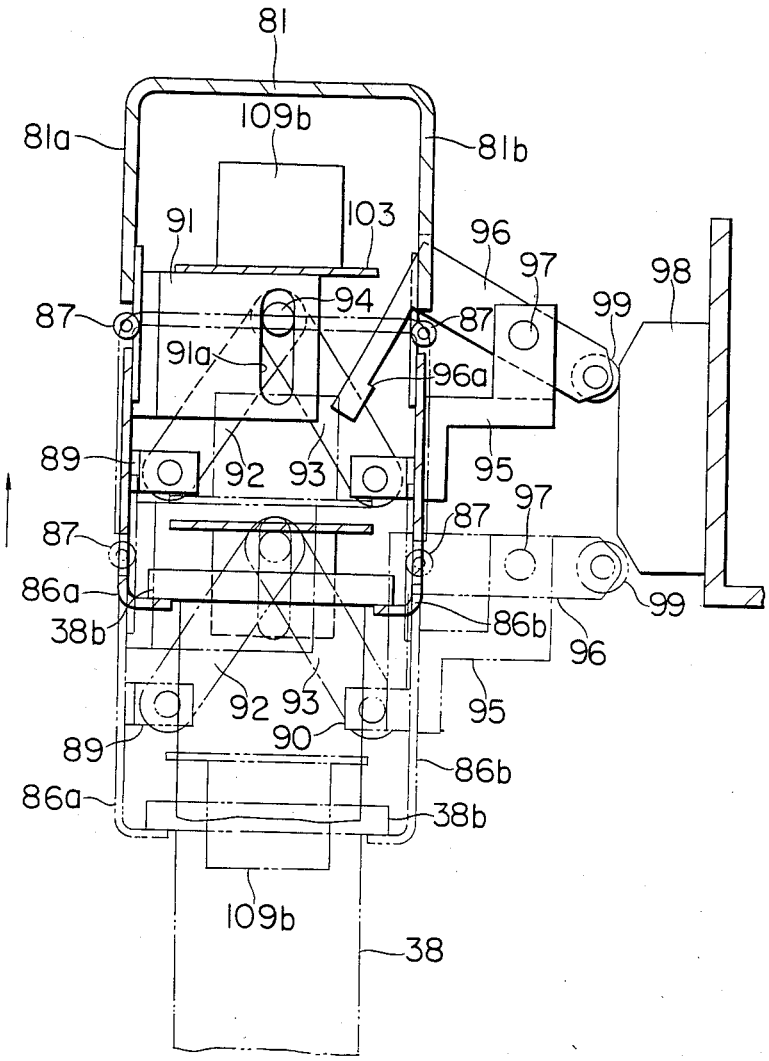

When the extension of the piston rod 79 to the predetermined position has been confirmed by the limit switch, not shown, the cylinder 77 is activated for receding the piston rod 79 and the suspension unit 80 starts to be elevated. When the suspension unit 80 has been elevated slightly, the guide rails 86*a*, 86*b* abut on the lower surface of the flange 38*b* of the empty bobbin 38. As the suspension unit 80 is elevated further from this position, the empty bobbins 38 are raised while remaining suspended between the guide rails 86*a*, 86*b*. When the operation of the cylinder 77 has ceased, the four empty bobbins 38 are maintained intermediate the engaging pieces 109*a* and 109*b*. During ascent of the suspension unit 80, when the end cam roller 96 of the rotary lever 96 abuts on cam 98, a downwardly directed force is applied to the rotary lever 96. The guide rails 86*a*, 86*b* are operatively connected to each other by the levers 92, 93 and the connecting pin 94 so as to perform simultaneous rotation while the guide rail 86*a* is inhibited from making a further inward movement from the position shown in FIG. 27 by the inner surface of the guide rail 86*a* abutting on the control bracket 89. Thus the rotary lever 96 is turned clockwise about shaft 97 against the force of the torsion spring 97*a* as indicated by the solid line in FIG. 27 and the guide rails 86*a*, 86*b* are raised to the position shown in FIG. 28 while being kept parallel to each other. Since guide rods 84 secured to the supporting shaft 83 are slid in the guide tubes 78 placed parallel to each other, the support member 81 is always moved vertically in the horizontal position.

Figure 28:
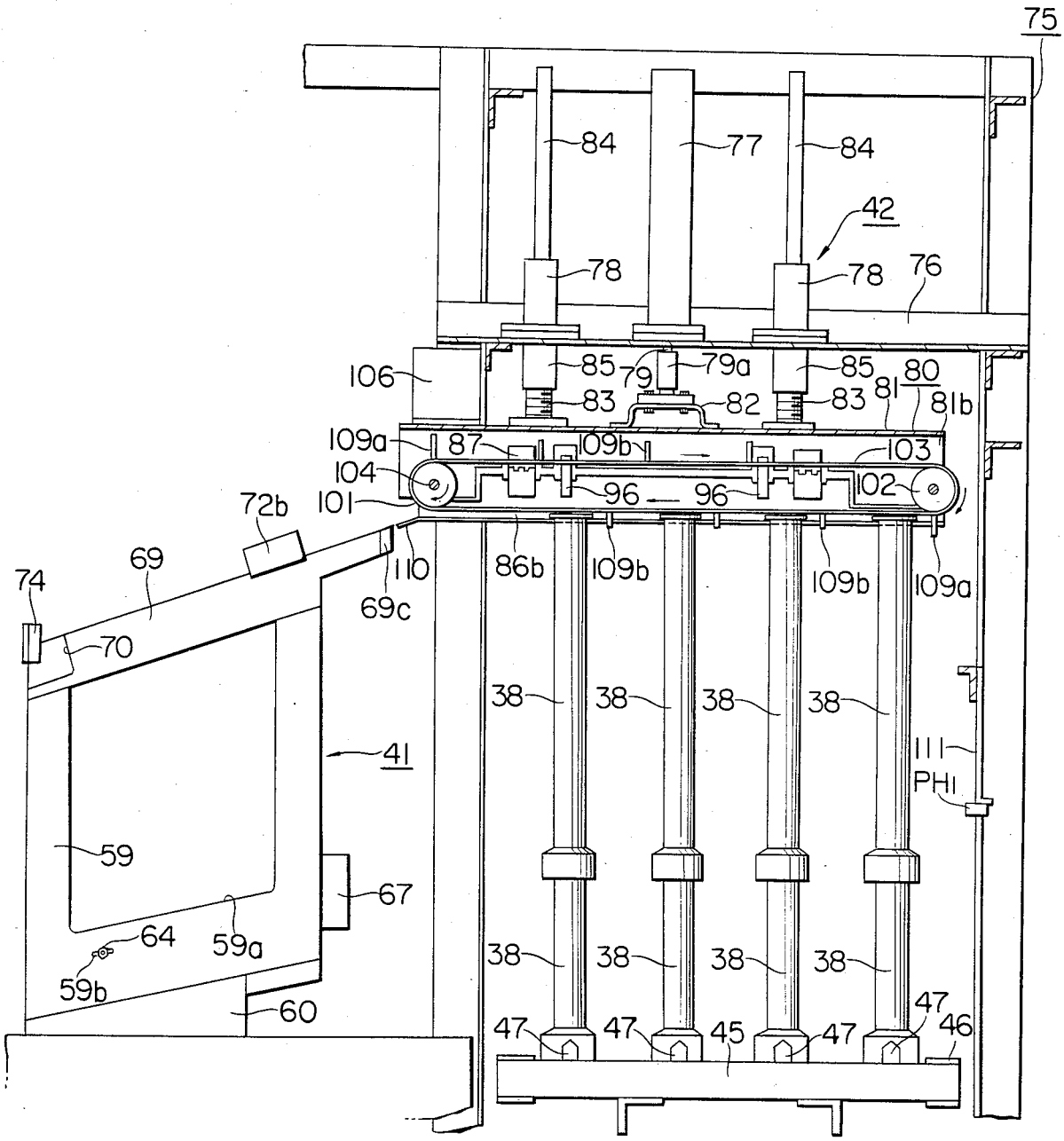
Figure 29:
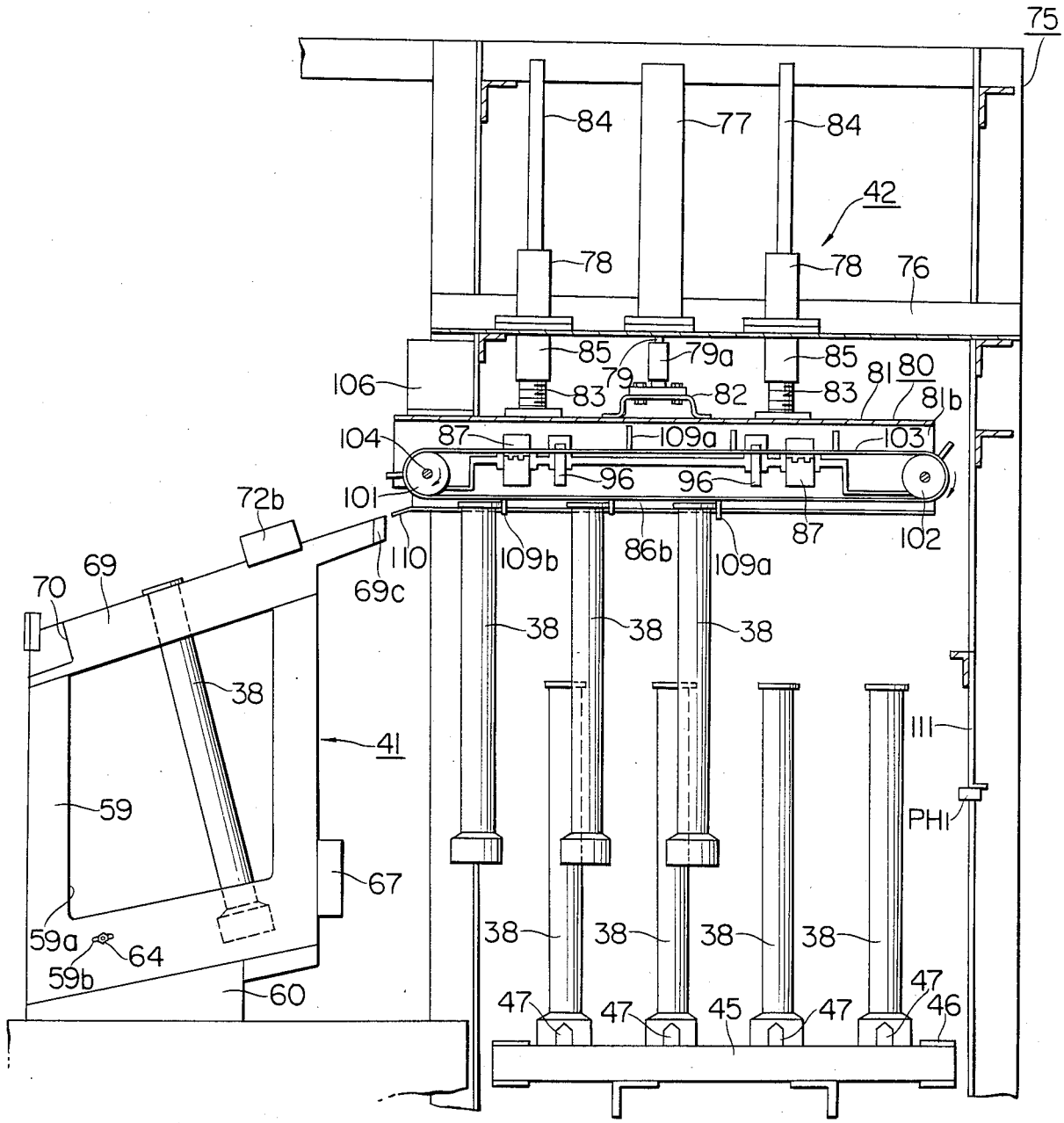

Referring to FIG. 28, the motor 106 is driven at the same time that retraction of the piston rod 79 to its predetermined position is confirmed by limit switch, not shown. Thus the pulley 101 is turned clockwise in FIGS. 28, 29 via pulleys 107, 105 and belt 108 (FIG. 15) and the toothed belt 103 is moved in the direction of the arrow mark in FIGS. 28, 29. As the belt 103 is moved in this manner, empty bobbins 38 suspended between the guide rails 86*a*, 86*b* are engaged by the engaging pieces 109*a*, 109*b* and thereby propelled towards left in FIGS. 28, 29 and thus towards the empty bobbin supply box 41 through guide piece 110. When the toothed belt 103 has moved one half its cyclic length, the four bobbins 38 suspended on the guide rails 86*a*, 86*b* are transported to the empty bobbin supply box 41. At this time, the engaging piece 109*a* is sensed by photocell (not shown) and the operation of the motor 106 ceases by the photocell signal. Thus the toothed belt 103 is positively stopped after it has completed one half its cyclic stroke length.

Figure 30:
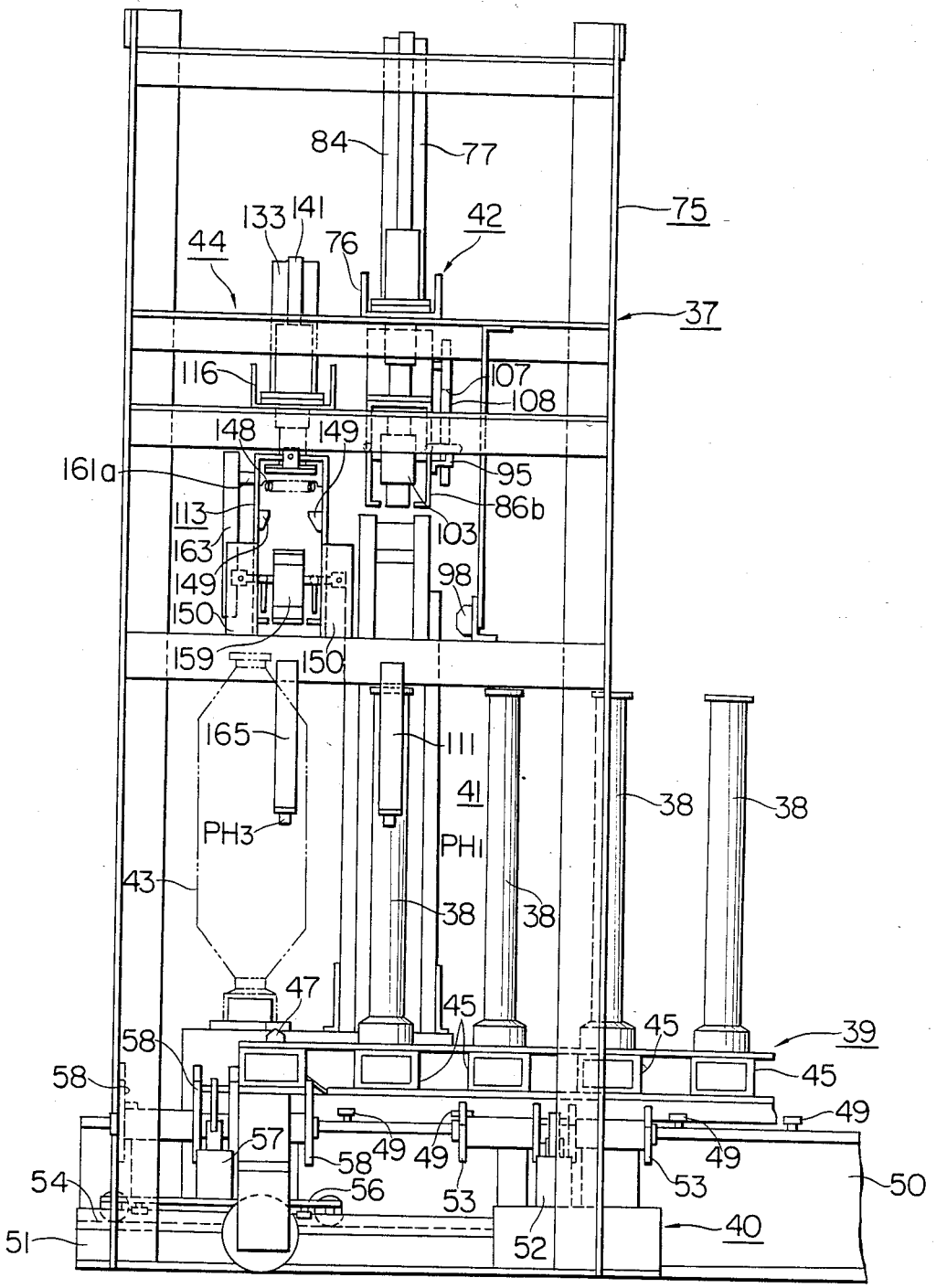
FIG. 30 is a side elevation showing the truck displaced by the intermittent feed unit.

The photocell signal is also effective to drive the intermittent feed unit 40. First, as shown in FIG. 11, the cylinder 55 is driven into operation, with the rotary lever 58 engaged with member 45 of the truck 39 and the truck securing levers 53 held in the non-engaging position. The truck 39 is moved forward (or towards left in FIG. 11) as one with the movable member 56 and a distance equal to the mounting pitch of the pegs 47. Thus, as shown in FIG. 30, the empty bobbins 38 of the second row are registered with the empty bobbin transport unit 42 whereas the members 47 on which the empty bobbins 38 of the first row were placed are registered with the full yarn package inserting device 113. Next, the solenoid 52 which has so far kept the truck securing levers 53 in the non-engaged position is turned off so that the truck securing levers 53 are turned to the position engaging with the member 45. The cylinder 57 associated with the rotary levers 58 are operated, the levers 58 being turned to the non-engaging positions. In this state, the cylinder 55 is again activated, the movable member 56 only being moved towards right in FIG. 30 and returned to the starting position shown in FIG. 11. By operation of the cylinder 57, the rotating levers 58 are turned to the position engaging with the tubular member 45. With the solenoid 52 turned on, truck securing levers 53 are swung to and maintained in the non-engaging position.

As the truck 39 proceeds further, the empty bobbins 38 of the second row are sensed by the photocell PH1 adapted for sensing empty cells, and the cylinder 77 is activated by the photocell signal. The empty bobbin suspension unit 80 is lowered so as to take out the empty bobbins 38 of the second row from the pegs and raised together with the bobbins 38 which are then suspended between the guide rails 86*a*, 86*b* in the same manner as mentioned hereinabove. However, at this time, the motor 106 is not driven instantly when the piston rod 79 has been returned to its predetermined position, and the empty bobbins 38 are suspended between the guide rails 86*a*, 86*b*. This is the point of demarcation from the otherwise similar operation of taking out the empty bobbins 38 of the first row.

Figure 31:
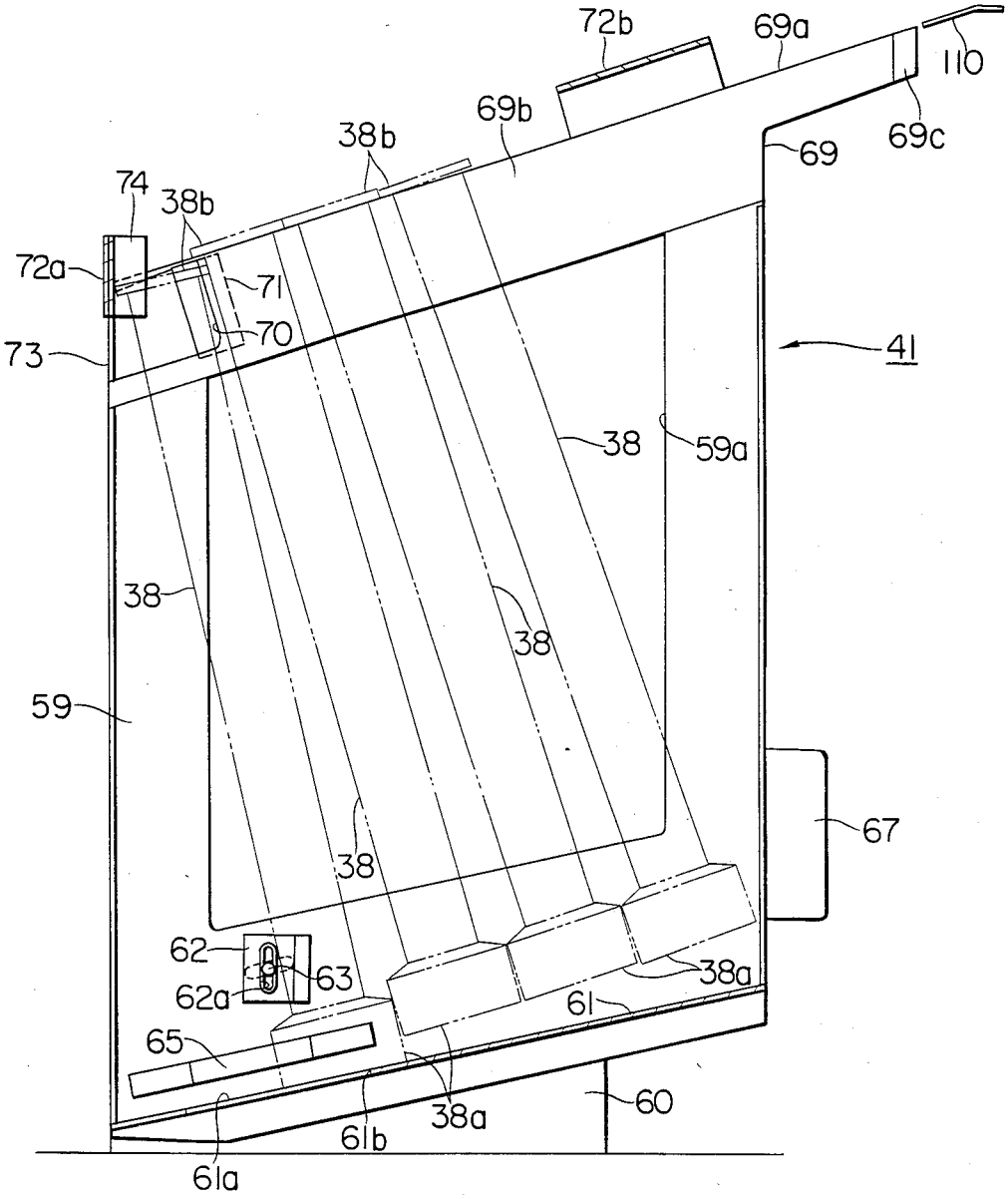
FIGS. 31 through 33 are longitudinal sectional views illustrating the operation of the empty bobbin supply box.

The leading empty bobbin 38 thus conveyed from the unit 42 to the supply box 41 is slid forwards (towards left in FIG. 31) on the guide surface 69*a* of the guide member 69. As the lesser diameter yarn winding section is guided by the rear extension 69*c* of the guide member 69 into the space between guide surfaces 69*b*, the larger diameter section 38*a* is introduced by the guide plate 67 into the space between the side walls 59 and the flange 38*b* is suspended over the guide surface 69*a*. As the flange 38*b* has reached the recess 70 of the guide member 69, the empty bobbin 38 has its larger diameter section 38*a* engaged by the engaging piece 62 which then inhibits forward travel of the empty bobbin. The bobbin 38 is then moved down in the recess 70 with the flange 38*b* engaged with the guide plate 74. As the bobbin 38 is moved down in this manner, its larger diameter section 38*a* is disengaged from the engaging piece 62 and the bobbin 38 is held on the bottom wall 61, with the bottom of the larger diameter section 38*a* resting on supporting rim 61*a* of the bottom wall 61 of the empty bobbin supply box 41, the periphery of the larger diameter section 38*a* abutting on plate spring 65 and the flange 38*b* on the guide-plate 74. Similarly to the leading bobbin, the second to fourth empty bobbins 38 are suspended from and slid on the guide surface 69*a*, with the respective bobbins 38 abutting on the preceding bobbins, as shown in FIG. 31.

Figure 32:
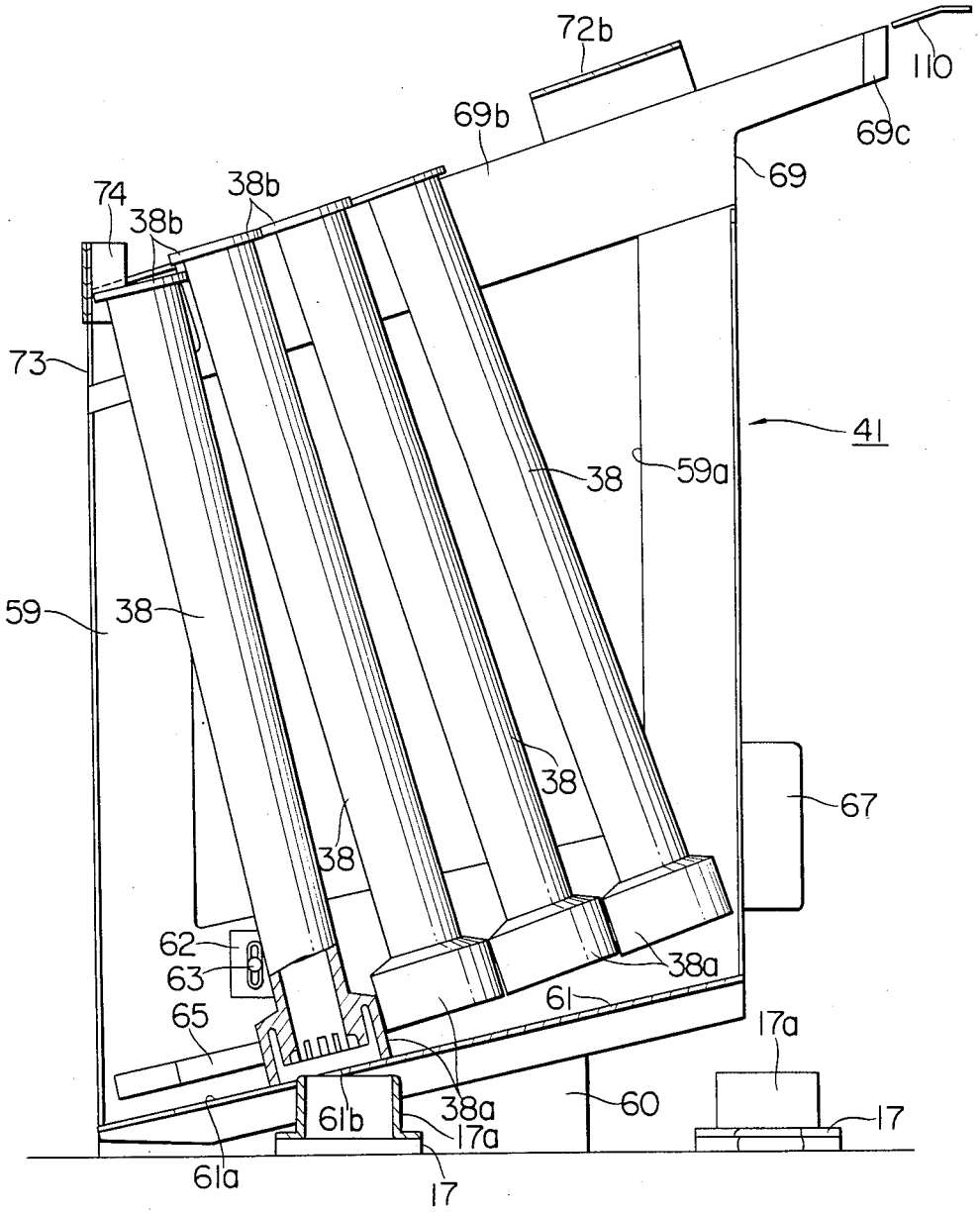
Figure 33:
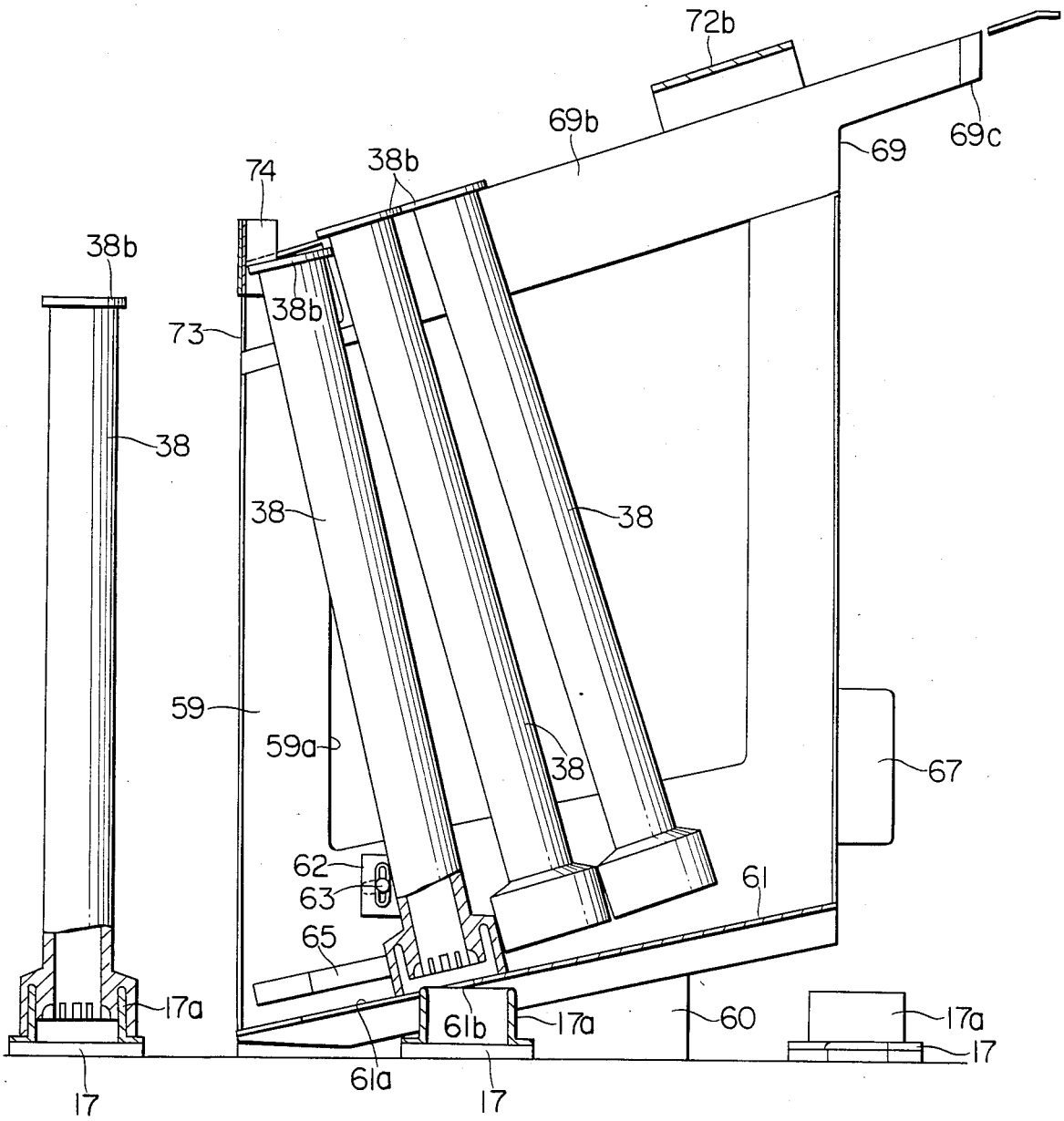

The bobbin holder 17, from the bobbin supporting tube 17*a* of which a full yarn package 43 was removed as will be described hereinafter, is conveyed by the movement of the chain conveyor 16 to the empty bobbin supply unit 41 through the turning section of the chain conveyor (FIG. 32). As the bobbin supporting tube 17*a* of the bobbin holder 17 has arrives at the recess 61*b* of the bottom wall 61, the lower inner periphery of the empty bobbin 38 held at the foremost part of the empty bobbin supply box 41 is engaged by the upper outer periphery of the bobbin supporting tube 17*a*. With movement of the bobbin holder 17, the bobbin 38 thus engaged is moved forwards against the action of the spring plate 65 and gradually fitted onto the tube 17*a*. In this manner, the bobbin is freed from the pressure of the spring 65 and placed on bobbin holder 17. The second empty bobbin 38 supported on guide surface 69*a* of guide member 69 is also supported on the bottom wall 61 as in the case of the leading empty bobbin 38 (FIG. 33). In a similar manner, the empty bobbins 38 in the supply box 41 are placed in ordered sequence on the bobbin holder 17. The engaging members 71, mounted to near the rear end of the recess 70 of the guide member 69, are engaged by the flange 38*b* of the empty bobbin 38 for preventing the empty bobbins 38 from leveling rearwards when the bobbins 38 are introduced onto the associated bobbin supporting tubes 17*a* of the bobbin holders 17. Although the first to third empty bobbins 38 are urged forwardly by the succeeding bobbins 38 and are not liable to level down towards the rear even in the absence of the engaging members 71, the fourth empty bobbin 38 is not supported by the succeeding empty bobbins and thus needs to be engaged by the engaging members 71.

Figure 34:
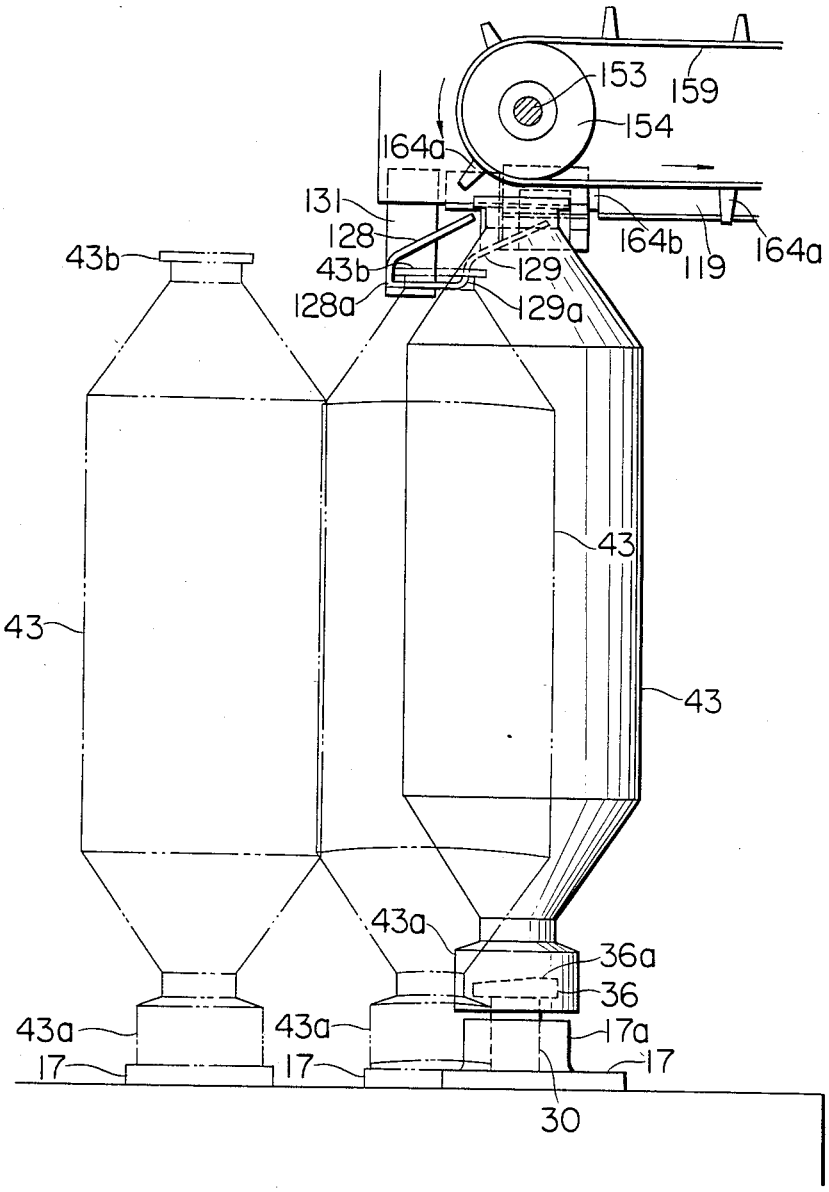
Figure 35:
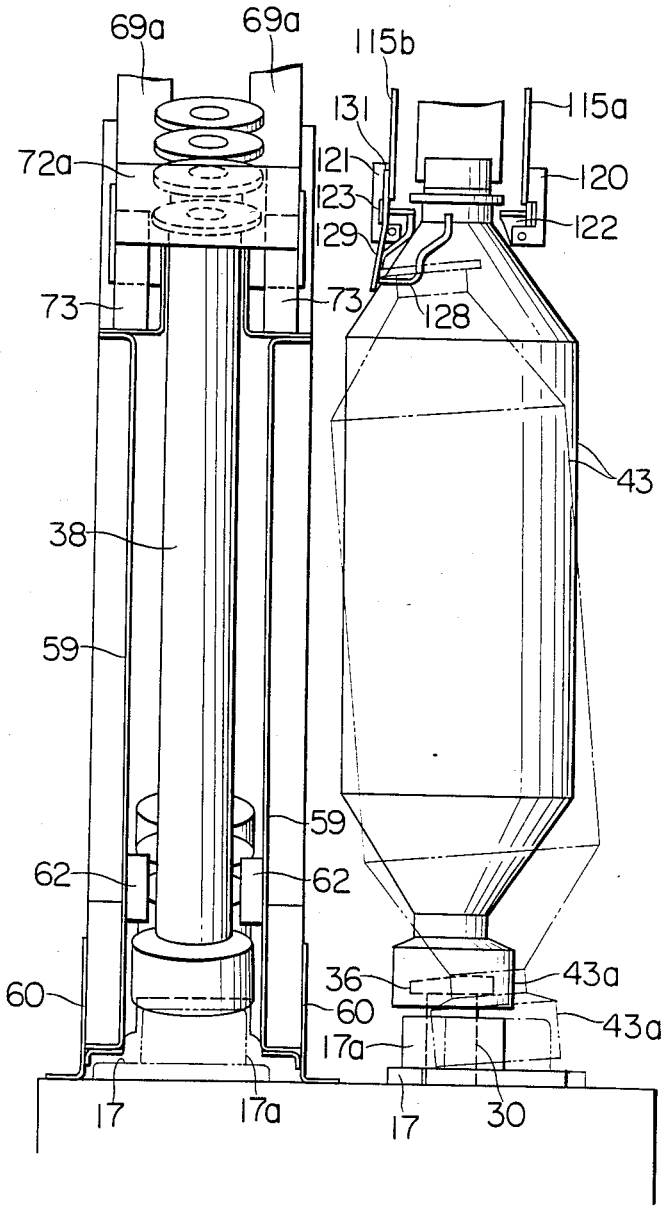

With rotation of the driving sprocket 14 and consequent operation of the chain conveyor 16, the bobbin holder 17 with the full yarn package 43 resting thereon is moved in the direction of the arrow mark in FIG. 10. As the bobbin holder 17 reaches the turning section, the axis of the bobbin supporting tube 17*a* is aligned with that of one of the four mounting holes 28 in the driving sprocket 14. As the sprocket 14 is turned from this position, the projection piece 30 fitted into the mounting hole 28 starts to be projected out of the mounting hole 28 by the action of the cam surface 35 against resiliency of coil spring 32. As the bobbin holder 17 has moved to a 10° position shown in FIG. 7, the engaging plate 36 of the projection piece 30 is engaged with the full yarn package 43 so as to push the full yarn package 43 upwards. By the action of the inclined surface 36*a* of the engaging plate 36, the package 43 is tilted in the direction of the center of rotation of the driving sprocket 14 and supported by two point abutment of the outer periphery of the flange 43*b* on the upright portions 128*a*, 129*a* of the guide bars 128, 129 (FIGS. 34 to 36).

Figure 37:
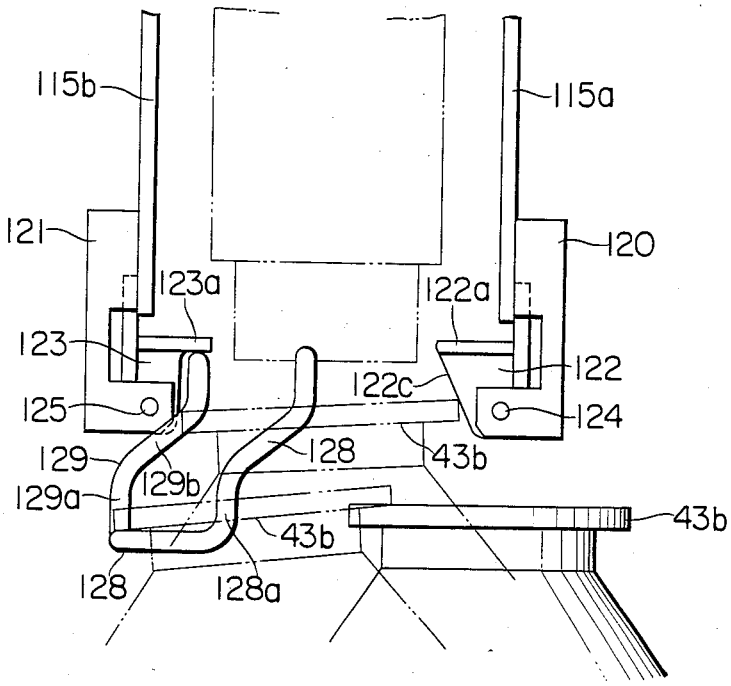
Figure 38:
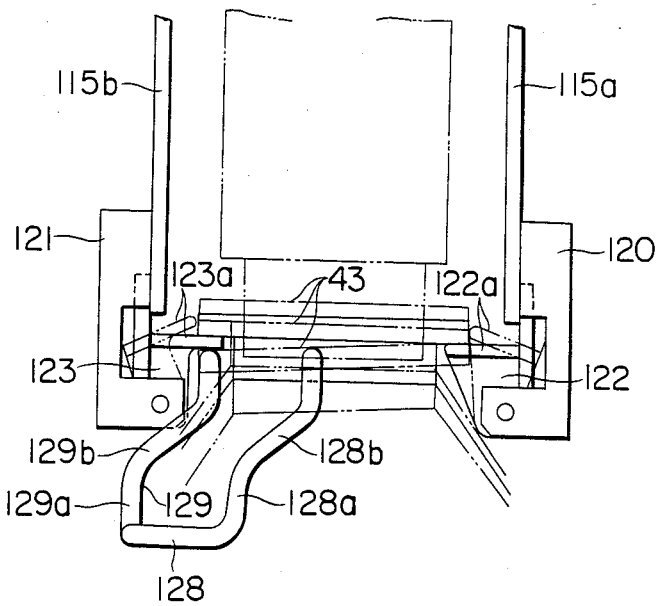

As the bobbin holder 17 is moved further at the turning section, the flange 43*b* is raised along the upright portions 128*a*, 129*a* of the guide bars 128, 129. The flange 43*b* is then moved in the direction of the center of the journal members 122, 123, with the upper and lower portions of the flange 43*b* engaging with the inclined portion 128*b* of the guide bar 128 and with the inclined portion 129*b* of the other guide bar 129, respectively, and the tilt of the package 43 being gradually reduced. The flange 43*b* thus guided by the journal members 122, 123 is engaged with cam surface 122*c* of the journal member 122 so as to cause the member 122 to turn upwards against the force of the torsion spring 126 (FIGS. 37, 38). It is then engaged with the lower surface of the journal surface 123*a* of the other journal member 123 so as to cause the journal member 123 to turn upwards. As the full yarn package 43 is raised, the journal members 122, 123 are freed from engagement from flange 43*b* and returned to their starting positions under the forces of the torsion springs 126, 127. At approximately the 45° position shown in FIG. 7, the projection piece 30 is raised to its uppermost point, with the full yarn package 43 being approximately in the upright position. As the driving sprocket 14 is turned further and the projection piece 30 starts to be lowered, the flange 43*b* is supported by the upper surface 122*a*, 123*a* of the journal members 122, 123 and sensed by the photosensor PH2. At this time the full yarn package 43 is suspended with the larger diameter portion 43*a* thereof completely extracted out of the bobbin supporting tube 17*a*.

Figure 36:
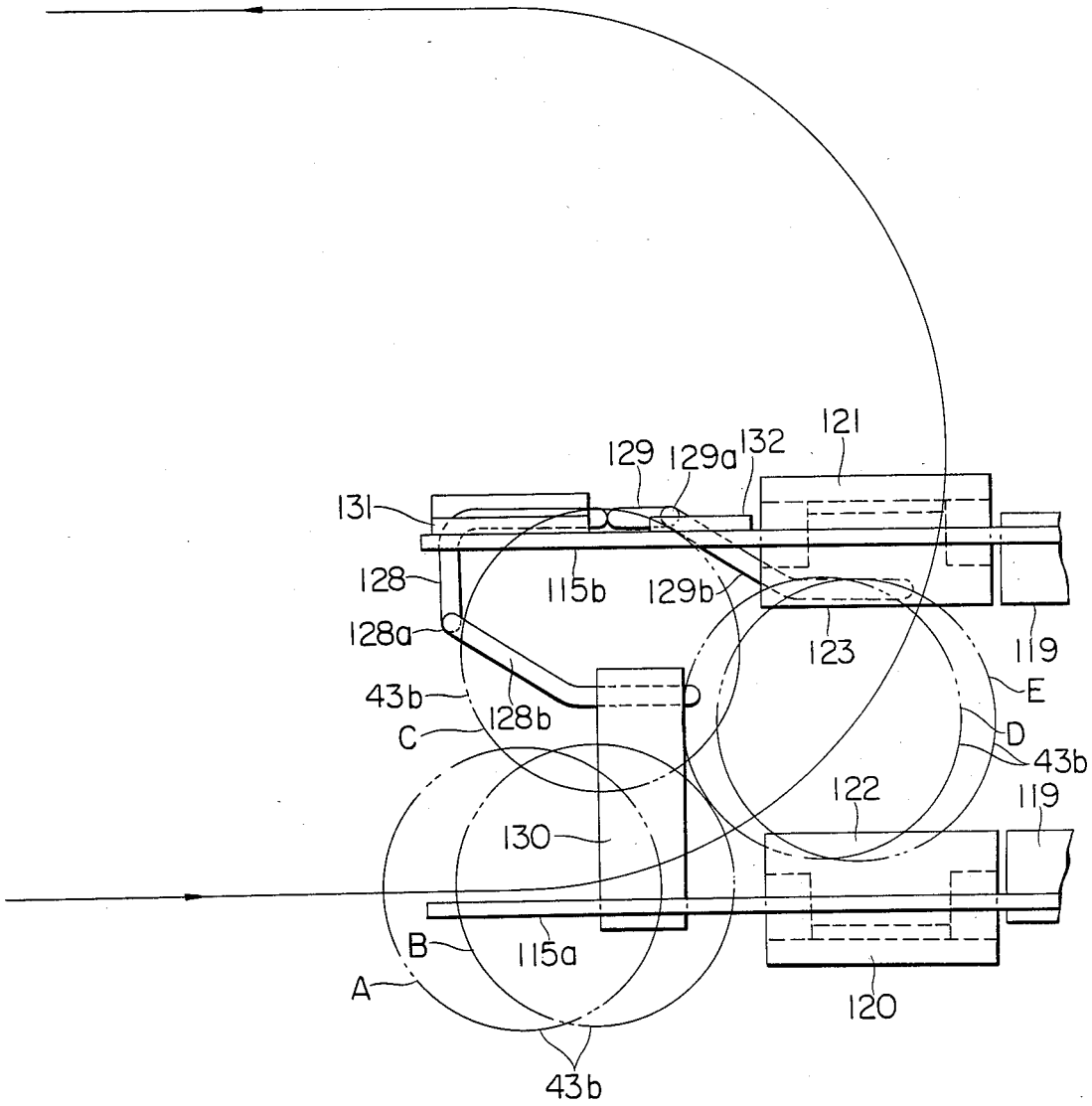

Thus, as the bobbin holder 17 is moved along the turning section as indicated by the arrow mark in FIG. 36, the flange 43*b* of the full yarn package 43 is moved through chain-line positions A, B, C, D and E shown in FIG. 36 in this order. The package 43 is tilted to the maximum extent when the flange 43*b* is at the position C, whereas it is substantially upright when the flange 43*b* is at the position E.

Figure 25:
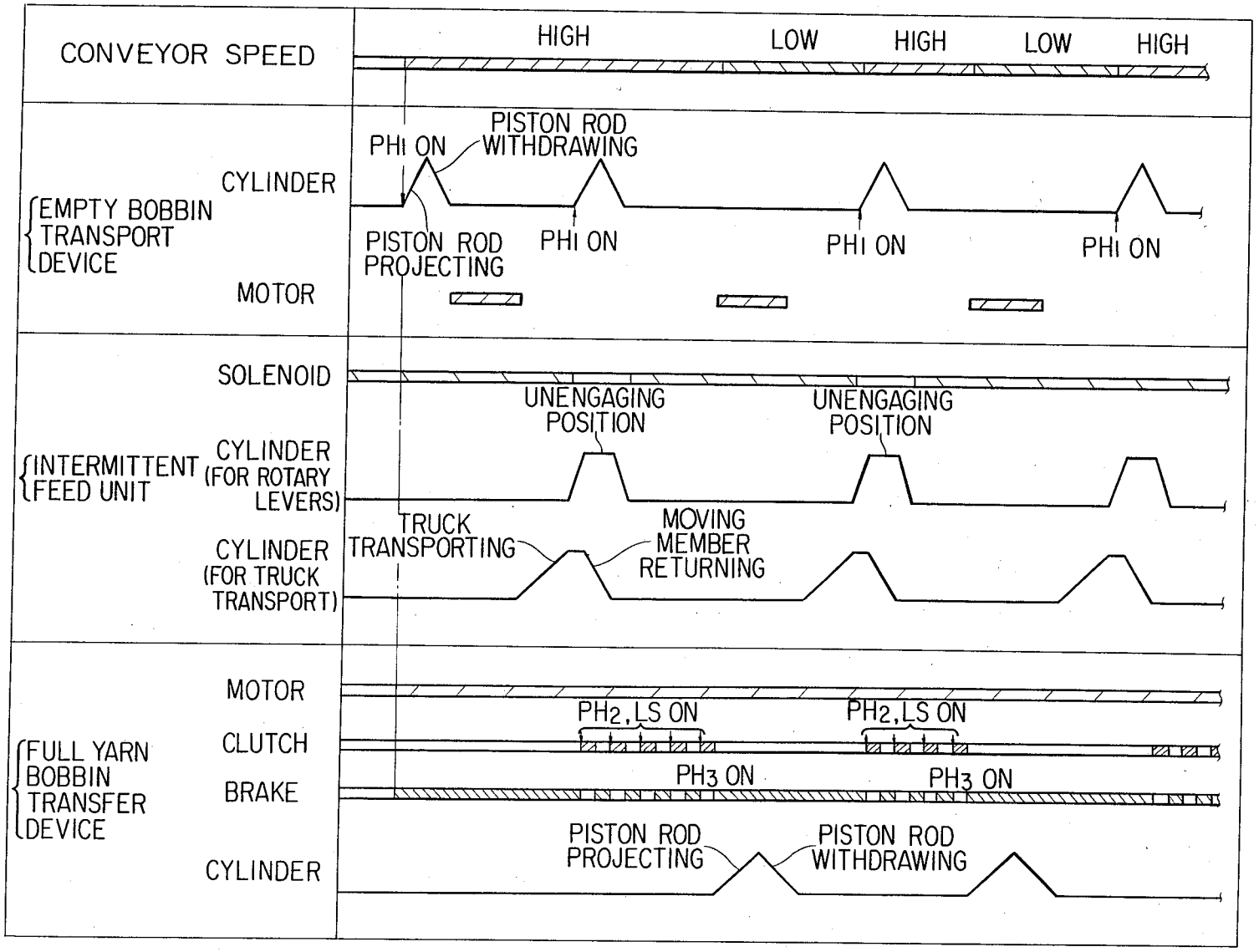
FIG. 25 is a time chart showing an operational sequence of the bobbin exchange operation.
Figure 39:
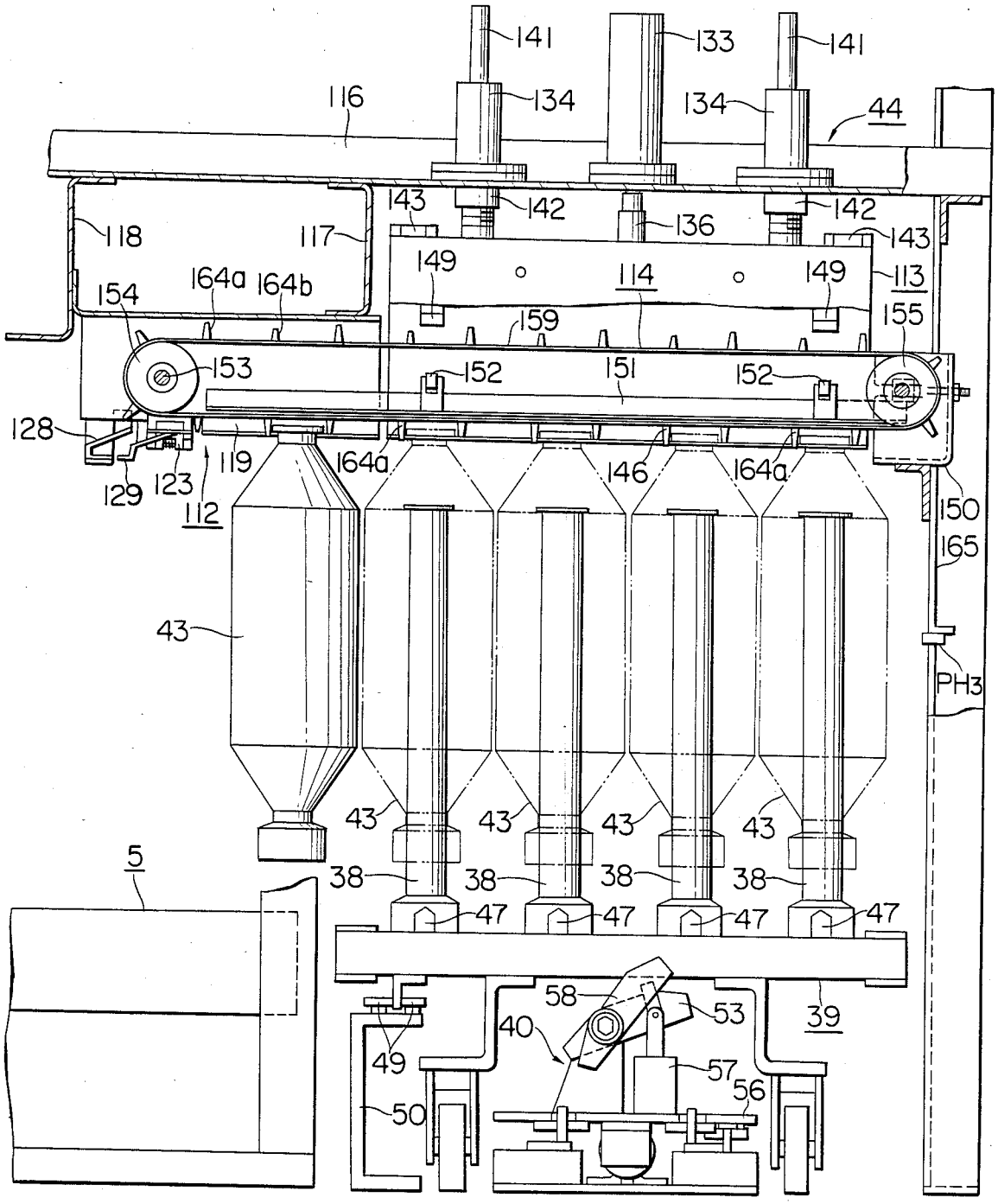

As the bobbin holder 17 is moved to a position such that the projection piece, thus far projected into the inside of the larger diameter section 43*a* of the full yarn package 43, is lowered and moved out of the section 43*a*, the outer periphery of the bobbin supporting tube 17*a* is engaged with limit switch LS. The output signal from the photocell PH2 and the ON signal from the limit switch LS are operative to connect the clutch of the driving shaft 161*a* to the output shaft of the motor 161. As shown in FIG. 25, the motor 161 is driven into operation simultaneously with driving of the chain conveyor 16 and the motor operation is continued until the bobbin exchange has been terminated for all of the spindles on the flyer frame, unless the operation is interrupted in an emergency. Thus, when the driving shaft 161*a* is connected by the clutch to the motor output shaft, rotation is transmitted from said output shaft to the rotary shaft 153 through driving shaft 161*a*, pulley 162, belt 163 and pulley 160. Thus the driving pulley 154 is turned counterclockwise in FIG. 34 and the toothed belt 159 moved in the direction of the arrow mark in the figure. The full yarn package 43 thus far suspended on the journal members 122, 123 is transported onto the rails 119 of the holding device 122, with the flange 43*b* being positioned between the engaging pieces 164*a*, 164*b* and pushed by the piece 164*a*. As the toothed belt 159 is shifted a distance equal to the mounting pitch of the engaging pieces 164*a*, the foremost part of the engaging piece 164*a* is sensed by a photocell, not shown. The output signal is operative to disconnect the clutch of the driving shaft 161*a* from the motor output shaft and to operate braking means. Thus the operation of the driving shaft 161*a* ceases while that of the toothed belt 159 also ceases. The full yarn package 43 is supported at the center of the rails 119 of the full yarn package holding device 112, as shown by solid line in FIG. 39.

Similarly, the full yarn packages 43 so far resting on bobbin holders 17 are suspended by the journal members 122, 123 by the combined action of the full yarn bobbin discharge mechanism and the guide bars 128, 129. The toothed belt 159 is moved intermittently each time the photosensor PH2 and limit switch LS are turned on so that the full yarn packages 43 are transferred in ordered sequence to the rails 146 of the full yarn package inserting device 113. As the four full yarn packages 43 are suspended by the rails 146, as indicated by double-dotted chain lines in FIG. 39, the right-hand side package 43 is sensed by photosensor PH3, and the cylinder 133 is driven by output signal from the photocell PH3.

Figure 40:
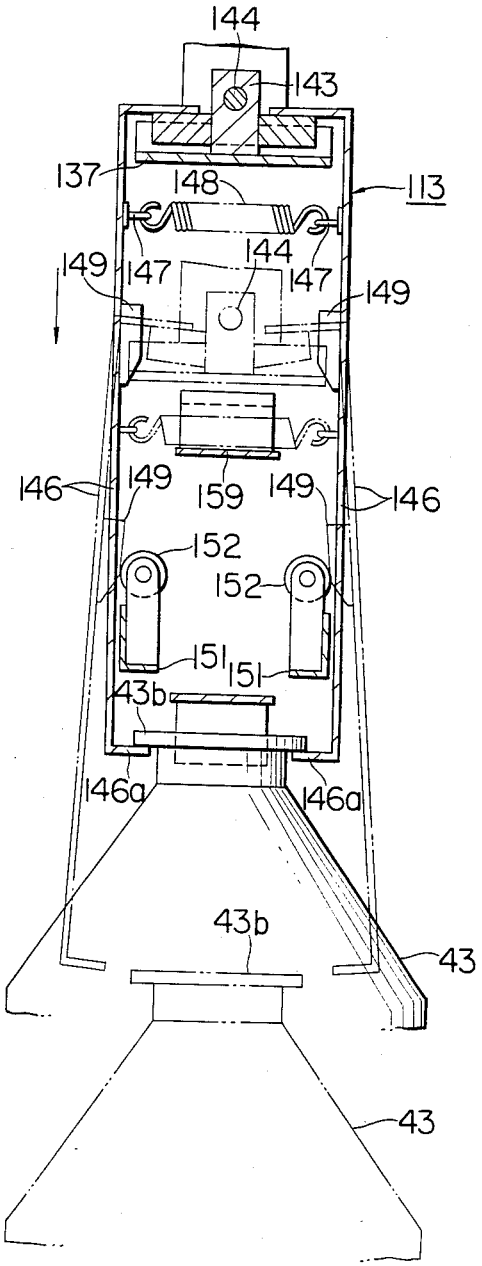
Figure 41:
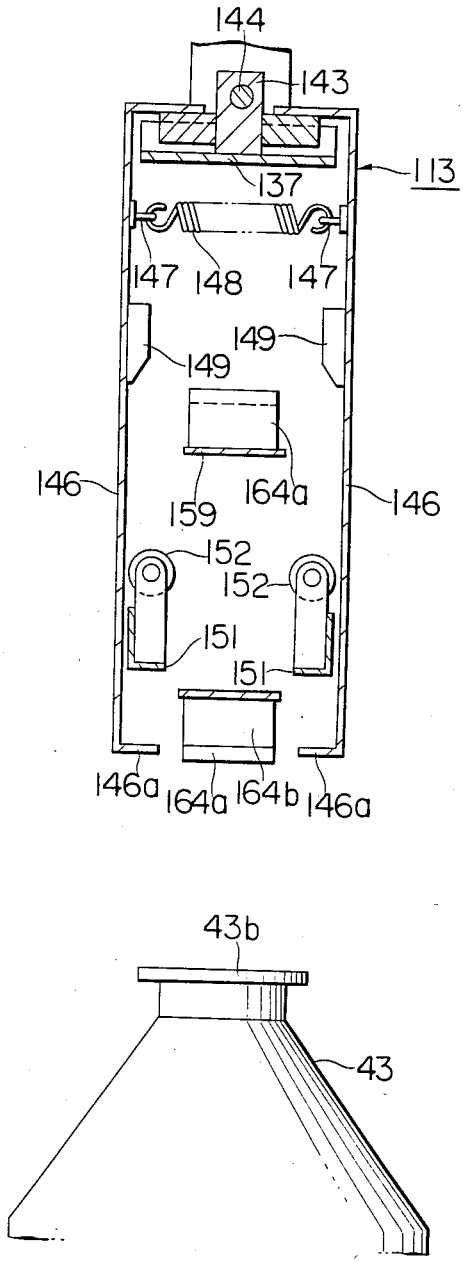
Figure 42:
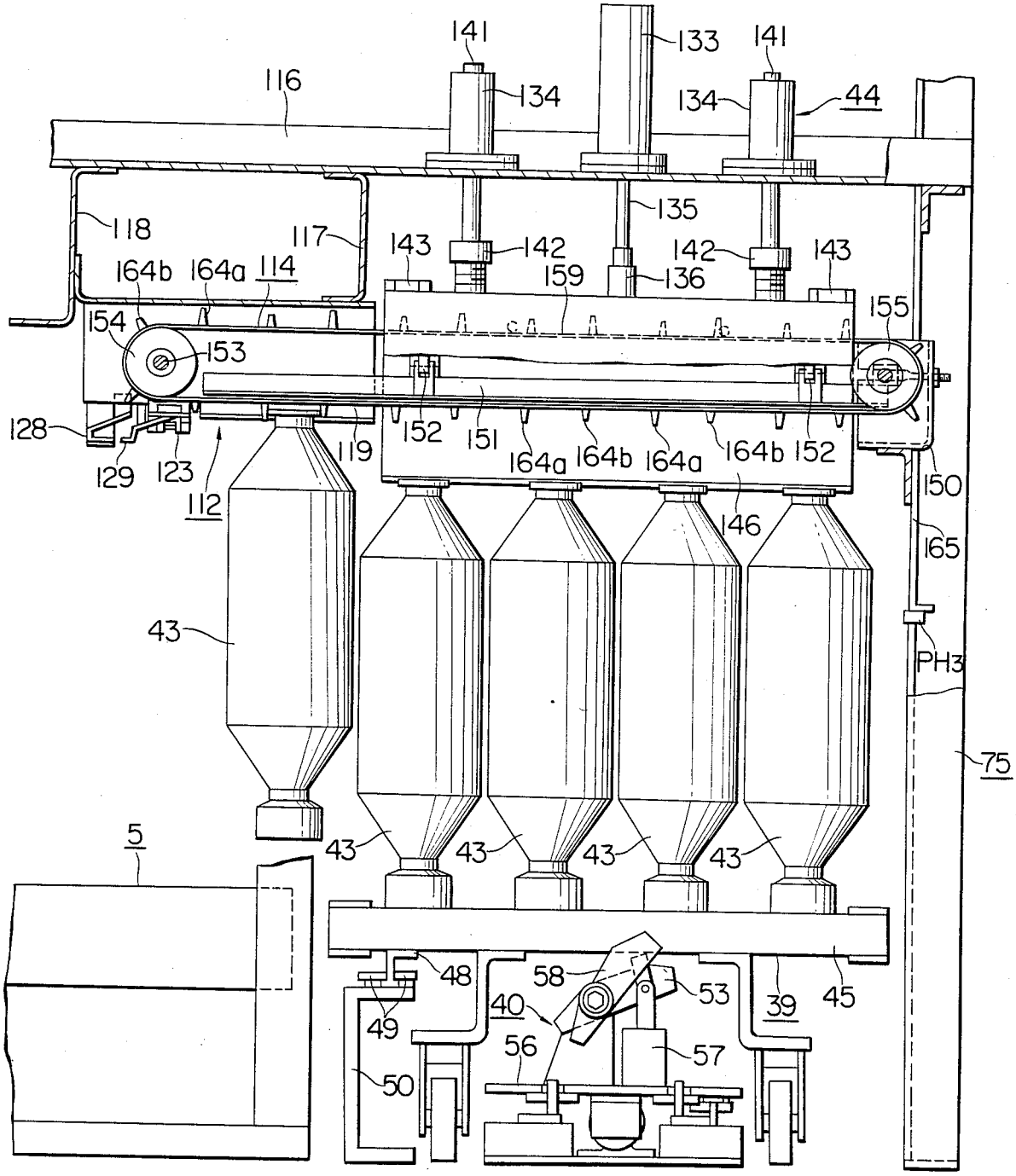

By the operation of the cylinder 133, piston rod 135 is projected downwards and the full yarn bobbin inserting device 113 starts to be lowered. At the instant the peg 47 on the truck 39 is introduced into the large diameter section 43*a* of the full yarn bobbin 43 suspended between bent edges 146*a* of the rails 146, the cams 149 projectedly mounted to the inner surface of the rails 146 start to abut on cam rollers 152. This causes the rails to be turned outwards, against the force of tension springs 148, as indicated by double-dotted chain line in FIG. 40, thus disengaging the flange 43*b* of the full yarn bobbin 43 from the bent edges of rails 146. The full yarn bobbin 43 is placed upright on horizontal members 45 of the truck 39, with the pegs 47 fitted into the full yarn bobbin, as shown in FIG. 42. When the projection of the piston rod 135 to the predetermined position has been confirmed by limit switch, not shown, piston rod 135 is drawn into cylinder 133 and the full yarn bobbin inserting device 113 is raised to its original position. When the inserting device 113 is elevated for disengaging the cams 149 from cam rollers 152, the rails 146 are returned to their original position by tension springs 148.

When the retraction of piston rod 135 to the predetermined position has been confirmed by a limit switch, not shown, the intermittent feed unit 40 is activated so that the truck 39 is displaced and the empty bobbins 38 of the third row arrive at the position in register with the empty bobbin transport unit 42, in a similar manner as mentioned hereinabove. The photosensor PH1 then senses the empty bobbin 38 so that the empty bobbin 38 is suspended by the empty bobbin suspension unit 80 in a similar fashion as mentioned hereinabove. It should be noted that, before the motor 106 is driven under the effect of the output signal from photocell PH3 for activating the transport unit 42, toothed belt 103 is moved one half its cyclic travel extent and all of the empty bobbins 38 of the second row thus far suspended by the empty bobbin suspension unit 80 are transferred to the empty bobbin supply box 41.

The full yarn packages 43 placed on bobbin holders 17 are transported in ordered sequence to the truck 39 and bobbin holders from which the full yarn packages were removed are loaded in ordered sequence with empty bobbins 38 supplied from empty bobbin supply box 41, in a similar manner as mentioned hereinabove. The bobbin exchange operation is terminated while chain conveyor 16 performs its full cycle travel stroke.

If it is desired to effect the bobbin exchange operation efficiently within a shorter time, it is necessary to increase the rate of travel of chain conveyor 16. However, when chain conveyor 16 is caused to travel at an elevated speed at all times, the full yarn packages 43 are removed from bobbin holders 17 and suspended by journal members 122, 123 while the full yarn package inserting device 113 performs its vertical travel stroke. Thus the full yarn bobbin transport device 114 is operated while the upper surface of the bent edges 146*a* of rails 146 provided on the inserting device 113 are not at the same level as the upper surface of the full yarn bobbin holding device 112, thus possibly causing operational trouble. However, in the present embodiment, since the chain conveyor 16 is driven at two speeds, that is, at a lower speed during vertical movement of the inserting device 113 and the following movement of the truck 39, and at a higher speed otherwise, the bobbin exchange operation can be carried out efficiently within a shorter time.

The present invention is not limited to the foregoing embodiment. For instance, the empty bobbin supply box 41 need not be mounted fixedly to conveyor cover 8 but may be movable in such a manner that it is retained in a position not interfering with the vertical movement of bobbin rail 6 during the twisting and winding operation of the flyer frame, and transferred to a predetermined position in register with the transport unit 42 when the bobbin rail 6 has been lowered upon termination of the twisting and winding operation, and the conveyor rail 7 has been set to the predetermined position. In the above embodiment, the truck 39 carrying empty bobbins 38 on the all of the pegs 47 thereof is conveyed to one end of the flyer frame after the twisting and winding operation of the flyer frame has been terminated and all of the full yarn packages have been placed on bobbin holders 17. However, this is not imperative and the truck 39 may be conveyed to one end of the flyer frame during its twisting and winding operation. In this case, the dwell time of the flyer frame may be reduced, because the bobbin exchange operation can be started the instant the full yarn package 43 has been placed on bobbin holder 17.

Effect:

According to the present invention, a truck carrying plural rows of vertically placed empty bobbins is conveyed to one end of the machine base of the flyer frame, the empty bobbins in the first row are taken from the truck and conveyed to an empty bobbin supply device on the machine base, the truck is moved a predetermined distance, and fresh full yarn packages from the flyer frame which have already been placed on a conveyor means are transferred to said truck at the positions occupied by the empty bobbins. The operation of taking empty bobbins from the truck and supplying them to the empty bobbin supplying device on the machine base and the operation of transferring the full yarn packages to said truck are performed in an alternate fashion. In this manner, the full yarn packages may be transferred to the truck for transport to the next step without damaging the yarn through mutual contact. In addition, a large storage space for a large number of long empty bobbins may be eliminated thus enabling the size of the overall device to be reduced. The full yarn bobbins may be transported by the truck in the vertical position thus facilitating automatic operation in the ensuing process.

What is claimed is:

1. A method of exchanging empty bobbins and full yarn packages on a flyer frame having a longitudinal base and in which all of said full yarn packages are disposed after doffing at equally spaced apart locations on an endless conveyor mounted substantially on said base for movement along a horizontal, substantially oval-shaped path in the longitudinal direction of said base, said conveyor extending to, and turning around a sprocket adjacent to an end of said base to provide first and second portions of said conveyor which respectively move towards and away from said base end during movement of said conveyor in one direction, said method comprising moving a horizontally portable bobbin truck to adjacent said base end to substantially align a plurality of laterally and equally spaced apart parallel rows of upright empty bobbins thereon with said longitudinal base for feeding said empty bobbins from said truck onto said conveyor and for feeding said full yarn packages from said conveyor onto said truck; grasping and moving a first of said rows of empty bobbins from said truck to deposite within an empty bobbin supply box adjacent to said second portion of said conveyor for subsequent substantially automatic feeding of said bobbins one at a time on to said second conveyor portion responsive to said conveyor movement, then displacing said truck transversely with respecti to said longitudinal base a distance substantially equal to said spacing between said bobbin rows thereon, moving a plurality of said full yarn packages from said conveyor first portion to deposit them within a row substantially corresponding to said first bobbin row on said truck, then grasping and moving a second of said rows of empty bobbins from said truck to deposit within said empty bobbin supply box, again displacing said truck said distance in said transverse direction, repeating said steps of grasping and moving the third and fourth of said rows of empty bobbins from said truck and moving a plurality of said full yarn packages from said first conveyor portion to deposit in rows corresponding to said second and third bobbin rows on said truck, and repeating the last said repeating step with respect to any remaining empty bobbin rows on said truck until all of said empty bobbins have been removed and substantially replaced by corresponding rows of said full yarn packages.

2. Apparatus for exchanging empty bobbins and full yarn packages on a flyer frame having a longitudinal base and an end, and an endless conveyor mounted substantially on said base for movement along a horizontal, substantially oval-shaped path extending substantially to said flyer frame end, said conveyor having a sprocket adjacent to said end and providing first and second portions of said conveyor which move respectively towards and away from said end during movement of said conveyor in one direction, said apparatus comprising a bobbin supply unit adjacent to said conveyor second portion for feeding empty bobbins one at a time in upright position onto the latter responsive to said movement of the conveyor, a movable bobbin truck having a plurality of bobbin holders arranged in laterally and equally spaced apart parallel rows for supporting said empty bobbins and said yarn packages in upright positions thereon, an intermittent feed unit adjacent to said flyer frame end for engaging and positioning said bobbin truck with its said parallel rows of bobbin holders extending substantially in the direction of said longitudinal base and having means for intermittently displacing said bobbin truck in transverse direction with respect to said longitudinal base sequential distances substantially equal to said lateral spacing between said rows of bobbin holders, an empty bobbin transport unit adjacent to said flyer frame end and having means for grasping a row of empty bobbins from one of said rows of bobbin holders and transporting the same to said bobbin supply unit, means for depositing said empty bobbins in said bobbin supply unit from said empty bobbin transport unit, a full yarn package transfer unit adjacent to said flyer frame end and substantially transversely adjacent to said empty bobbin transport unit whereby said intermittent displacing movement of said truck moves each successive row of said bobbin holders from beneath said empty bobbin transport unit to beneath said full yarn package transfer unit, means for feeding a row of full yarn packages from said first conveyor portion into said full yarn package transfer unit responsive to said movement of said conveyor, said full yarn package transfer unit having releasable grasping means for receiving said row of full yarn packages including means for positioning the respective packages in said row over, and depositing the same on the respective of said bobbin holders in a row thereof on said bobbin truck, and means for coordinating the operations of said conveyor, said intermittent feed unit, said empty bobbin transport unit, and said full yarn package transfer unit for alternately and sequentially transporting empty bobbins from one row of bobbin holders on said bobbin truck to said bobbin supply unit, displacing said bobbin truck said distance, and depositing said row of full yarn packages from said full yarn package transfer unit on to said one row of bobbin holders.

3. Apparatus according to claim 2, wherein said bobbin truck comprises a loading section comprising a plurality of laterally spaced apart horizontal members each having said bobbin holders mounted in longitudinally spaced apart relation thereon, and a pair of plates in spaced apart relation, each of said horizontal members extending between and being attached to said pair of plates.

4. Apparatus according to claim 3, wherein said intermittent feed unit further comprises a fixed rail extending transversely at said end of the flyer frame, said rail carrying guide means therealong, and said bobbin truck loading section further comprises a control plate extending transversely with respect to said horizontal members and engaging said rail guide means during said displacement movement of said bobbin truck.

5. Apparatus according to claim 4, wherein said intermittent feed unit further comprises a plurality of truck securing levers pivotally mounted thereon for alternately engaging and disengaging each of said horizontal members on said bobbin truck to retain said truck in its intermittently displaced positions, an intermittently movable member mounted for reciprocal movement in said transverse direction, and a plurality of rotary levers pivotally mounted on said movable member for alternately engaging and disengaging said loading section, whereby movement of said movable member with its said rotary levers in engagement with said loading section displaces said truck said distance, and said engagement of said truck securing levers secures said truck in its displaced position.

6. Apparatus according to claim 4, wherein said empty bobbin transport unit is substantially in alignment with said bobbin supply unit.

7. Apparatus according to claim 3, wherein said intermittent feed unit further comprises a plurality of truck securing levers pivotally mounted thereon for alternately engaging and disengaging each of said horizontal members on said bobbin truck to retain said truck in its intermittently displaced positions, an intermittently movable member mounted for reciprocal movement in said transverse direction, and a plurality of rotary levers pivotally mounted on said movable member for alternately engaging and disengaging said loading section, whereby movement of said movable member with its said rotary levers in engegement with said loading section displaces said truck said distance, and said engagement of said truck securing levers secures said truck in its displaced position.

8. Apparatus according to claim 7, wherein said truck securing levers are solenoid-operated, and said movable member is cylinder-operated.

9. Apparatus according to claim 8, wherein said rotary levers are cylinder-operated.

10. Apparatus according to claim 3, wherein said full yarn package transfer device is substantially parallel to, and transversely spaced from said empty bobbin transport unit a distance substantially equal to said spacing distances between said rows of bobbin holders on said bobbin truck.

11. Apparatus according to claim 2, wherein said means for feeding a row of full yarn packages from said first conveyor portion into said full yarn package transfer means comprises aperture means of said sprocket, cam means beneath said sprocket and aligned with the path of movement of said sprocket aperture means during movement of the sprocket, and full yarn package lifter means in cam follower engagement with said cam means and movable with said sprocket for extending upwardly through said sprocket aperture means to lift each said full yarn package towards said full yarn package transfer means responsive to said movement of said conveyor, said full yarn package transfer means having means extending above said sprocket for receiving and retaining each said lifted full yarn package.

* * * * *